US005637194A

United States Patent [19]

Ampulski et al.

[11] Patent Number: 5,637,194

[45] Date of Patent: Jun. 10, 1997

[54] WET PRESSED PAPER WEB AND METHOD OF MAKING THE SAME

[75] Inventors: Robert S. Ampulski, Fairfield; Albert H. Sawdai, Cincinnati; Paul D. Trokhan, Hamilton, all of Ohio

[73] Assignee: The Procter & Gamble Company, Cincinnati, Ohio

[21] Appl. No.: 358,661

[22] Filed: Dec. 19, 1994

Related U.S. Application Data

[63] Continuation-in-part of Ser. No. 170,140, Dec. 20, 1993.

[51] Int. Cl.[6] ..... D21H 11/00

[52] U.S. Cl. ..... 162/109; 428/153

[58] Field of Search ..... 428/153, 171; 162/109, 188, 117

[56] References Cited

U.S. PATENT DOCUMENTS

| | | | |
|---|---|---|---|
| Re. 32,713 | 7/1988 | Woo | 428/240 |
| D. 239,137 | 3/1976 | Appleman | D59/2 A |
| 369,957 | 9/1887 | Palmer . | |
| 391,582 | 10/1888 | Chase . | |

(List continued on next page.)

FOREIGN PATENT DOCUMENTS

| | | |
|---|---|---|
| 1099588 | 4/1981 | Canada . |
| 2109781 | 5/1995 | Canada . |
| 0033988 | 8/1981 | European Pat. Off. . |
| 0400843A2 | 12/1990 | European Pat. Off. . |
| 0498623A2 | 8/1992 | European Pat. Off. . |
| 0499942A2 | 8/1992 | European Pat. Off. . |
| 0549553A1 | 6/1993 | European Pat. Off. . |
| 0566775A1 | 10/1993 | European Pat. Off. . |
| 0604074A1 | 6/1994 | European Pat. Off. . |
| 0604824A1 | 7/1994 | European Pat. Off. . |
| 0616074A1 | 9/1994 | European Pat. Off. . |
| 2254288A | 10/1992 | United Kingdom . |
| WO91/14558 | 10/1991 | WIPO . |
| WO92/17643 | 10/1992 | WIPO . |
| WO93/00475 | 1/1993 | WIPO . |
| WO94/04750 | 3/1994 | WIPO . |
| WO94/06623 | 3/1994 | WIPO . |
| WO94/24366 | 10/1994 | WIPO . |

OTHER PUBLICATIONS

Article entitled "Photocross–Linkable Resin Systems" written by Green et al., J. Macro–Sci Revs. Macro Chem., C21 (2), 187–273 (1981–82).

Article entitled "Ultraviolet Curable Flexible Coatings" written by Schmidle, J. of Coated Fabrics, 8, 10–20 (Jul. 1978).

(List continued on next page.)

*Primary Examiner*—Brenda A. Lamb

*Attorney, Agent, or Firm*—Gerry S. Gressel; Larry L. Huston; E. Kelly Linman

[57] ABSTRACT

The present invention provides a wet pressed paper web. The web has a first relatively high density region having a first thickness K, a second relatively low density region having a second thickness P, which is a local maxima, and a third region extending intermediate the first and second regions. The third region includes a transition region having a third thickness T, which is a local minima. The present invention also provides a method of making a wet pressed web. An embryonic web of papermaking fibers is formed on a foraminous forming member, and transferred to an imprinting member to deflect a portion of the papermaking fibers in the embryonic web into deflection conduits in the imprinting member. The web and the imprinting member are then pressed between first and second dewatering felts in a compression nip to further deflect the papermaking fibers into the deflection conduits in the imprinting member and to remove water from both sides of the web. The imprinting member can have a continuous, monoplanar web contacting surface for molding a wet paper web to have a continuous, relatively high density network and a plurality of relatively low density, discrete domes dispersed through the relatively high density network.

16 Claims, 11 Drawing Sheets

U.S. PATENT DOCUMENTS

| | | | |
|---|---|---|---|
| 2,537,129 | 1/1951 | Goodwillie | 92/49 |
| 2,940,891 | 6/1960 | Muller | 162/113 |
| 3,014,832 | 12/1961 | Donnelly | 162/111 |
| 3,230,136 | 1/1966 | Krake | 162/111 |
| 3,301,746 | 1/1967 | Sanford et al. | 162/113 |
| 3,303,576 | 2/1967 | Sisson | 34/115 |
| 3,306,814 | 2/1967 | McHugh | 162/358 |
| 3,414,459 | 12/1968 | Wells | 161/131 |
| 3,537,954 | 11/1970 | Justus | 162/305 |
| 3,549,742 | 12/1970 | Benz | 264/250 |
| 3,556,907 | 1/1971 | Nystrand | 156/470 |
| 3,629,056 | 12/1971 | Forrest | 162/305 |
| 3,824,152 | 7/1974 | Nevalainen | 162/301 |
| 3,840,429 | 10/1974 | Busker et al. | 162/205 |
| 3,867,225 | 2/1975 | Nystrand | 156/209 |
| 3,905,863 | 9/1975 | Ayers | 162/113 |
| 3,981,084 | 9/1976 | Sobota | 34/123 |
| 3,994,771 | 11/1976 | Morgan, Jr. et al. | 162/113 |
| 4,102,737 | 7/1978 | Morton | 162/113 |
| 4,139,410 | 2/1979 | Tapio et al. | 162/206 |
| 4,144,124 | 3/1979 | Turunen et al. | 162/290 |
| 4,191,609 | 3/1980 | Trokhan | 162/113 |
| 4,196,045 | 4/1980 | Ogden | 162/117 |
| 4,239,065 | 12/1980 | Trokhan | 139/383 A |
| 4,250,172 | 2/1981 | Mutzenberg et al. | 428/234 |
| 4,300,981 | 11/1981 | Carstens | 162/109 |
| 4,302,282 | 11/1981 | Young | 162/111 |
| 4,309,246 | 1/1982 | Hulit et al. | 162/113 |
| 4,356,059 | 10/1982 | Hostetler | 162/111 |
| 4,390,574 | 6/1983 | Wood | 428/36 |
| 4,420,372 | 12/1983 | Hostetler | 162/280 |
| 4,421,600 | 12/1983 | Hostetler | 162/111 |
| 4,446,187 | 5/1984 | Eklund | 428/136 |
| 4,464,432 | 8/1984 | Dost et al. | 428/280 |
| 4,514,345 | 4/1985 | Johnson et al. | 264/22 |
| 4,528,239 | 7/1985 | Trokhan | 428/247 |
| 4,529,480 | 7/1985 | Trokhan | 162/109 |
| 4,533,437 | 8/1985 | Curran et al. | 162/281 |
| 4,637,859 | 1/1987 | Trokhan | 162/109 |
| 4,740,409 | 4/1988 | Lefkowitz | 428/131 |
| 4,759,967 | 7/1988 | Bauernfeind | 428/154 |
| 4,795,480 | 1/1989 | Boyer et al. | 51/296 |
| 4,973,383 | 11/1990 | Filzen | 162/358 |
| 5,062,924 | 11/1991 | McCarten et al. | 162/358 |
| 5,098,522 | 3/1992 | Smurkoski et al. | 162/358 |
| 5,126,015 | 6/1992 | Pounder | 162/206 |
| 5,217,799 | 6/1993 | Smuii et al. | 428/280 |
| 5,236,778 | 8/1993 | Landis et al. | 428/282 |
| 5,245,025 | 9/1993 | Trokhan et al. | 536/56 |
| 5,275,700 | 1/1994 | Trokhan et al. | 162/358.1 |
| 5,277,761 | 1/1994 | Phan et al. | 162/109 |
| 5,328,565 | 7/1994 | Rasch et al. | 162/113 |
| 5,334,289 | 8/1994 | Trokhan et al. | 162/358.2 |
| 5,336,373 | 8/1994 | Scattolino et al. | 162/116 |
| 5,346,567 | 9/1994 | Barnewall | 156/78 |

OTHER PUBLICATIONS

Article entitled "A Review of Ultraviolet Curing Technology" written by Bayer, Tappi Paper Synthetics Conf. Proc., Sep. 25–27, 1978, pp. 167–172.

Tappi Journal Article, vol. 56, No. 6, dated Jun., 1973 entitled "An Analysis of Table Roll Drainage Using the Taylor–Bergstrom Theory" authored by H. Meyer and G. R. Brown.

Pulp & Paper Magazine Can. (1958) pp. 172–176 entitled "Drainage at a Table Roll and a Foil" authored by G. I. Taylor, F. R. S.

WET PRESSED PAPER WEB AND METHOD OF MAKING THE SAME

This patent application is a continuation-in-part of U.S. patent application Ser. No. 08/170,140 filed Dec. 20, 1993 in the name of Ampulski, et al.

FIELD OF THE INVENTION

The present invention is related to papermaking, and more particularly, to a wet pressed paper web and a method for making such a web.

BACKGROUND OF THE INVENTION

Disposable products such as facial tissue, sanitary tissue, paper towels, and the like are typically made from one or more webs of paper. If the products are to perform their intended tasks, the paper webs from which they are formed must exhibit certain physical characteristics. Among the more important of these characteristics are strength, softness, and absorbency. Strength is the ability of a paper web to retain its physical integrity during use. Softness is the pleasing tactile sensation the user perceives as the user crumples the paper in his or her hand and contacts various portions of his or her anatomy with the paper web. Softness generally increases as the paper web stiffness decreases. Absorbency is the characteristic of the paper web which allows it to take up and retain fluids. Typically, the softness and/or absorbency of a paper web is increased at the expense of the strength of the paper web. Accordingly, papermaking methods have been developed in an attempt to provide soft and absorbent paper webs having desirable strength characteristics.

U.S. Pat. No. 3,301,746 issued to Sanford et al. discloses a paper web which is thermally pre-dried with a through air-drying system. Portions of the web are then impacted with a fabric knuckle pattern at the dryer drum. While the process of Sanford et al. is directed to providing improved softness and absorbency without sacrificing tensile strength, water removal using the through-air dryers of Sanford et al. is very energy intensive, and therefore expensive.

U.S. Pat. No. 3,537,954 issued to Justus discloses a web formed between an upper fabric and a lower forming wire. A pattern is imparted to the web at a nip where the web is sandwiched between the fabric and a relatively soft and resilient papermaking felt. U.S. Pat. No. 4,309,246 issued to Hulit et al. discloses delivering an uncompacted wet web to an open mesh imprinting fabric formed of woven elements, and pressing the web between a papermaker's felt and the imprinting fabric in a first press nip. The web is then carried by the imprinting fabric from the first press nip to a second press nip at a drying drum. U.S. Pat. No. 4,144,124 issued to Turunen et al. discloses a paper machine having a twin-wire former having a pair of endless fabrics, which can be felts. One of the endless fabrics carries a paper web to a press section. The press section can include the endless fabric which carries the paper web to the press section, an additional endless fabric which can be a felt, and a wire for pattern embossing the web.

Both Justus and Hulit et al. suffer from the disadvantage that they press a wet web in a nip having only one felt. During pressing of the web, water will exit both sides of the web. Accordingly, water exiting the surface of the web which is not in contact with a felt can re-enter the web at the exit of the press nip. Such re-wetting of the web at the exit of the press nip reduces the water removal capability of the press arrangement, disrupts fiber-to-fiber bonds formed during pressing, and can result in rebulking of the portions of the web which are densified in the press nip.

Turunen et al. discloses a press nip which includes two endless fabrics, which can be felts, and an imprinting wire. However, Turunen et al. does not transfer the web from a forming wire to an imprinting fabric to provide initial deflection of portions of the wet web into the imprinting fabric prior to pressing the web in the press nip. The web in Turunen can therefore be generally monoplanar at the entrance to the press nip, resulting in overall compaction of the web in the press nip. Overall compaction of the web is undesirable because it limits the difference in density between different portions of the web by increasing the density of relatively low density portions of the web.

In addition, Hulit et al., and Turunen et al. provide press arrangements wherein the imprinting fabric has discrete compaction knuckles, such as at the warp and weft crossover points of woven filaments. Discrete compacted sites do not provide a wet molded sheet having a continuous high density region for carrying loads and discrete low density regions for providing absorbency.

Embossing can also be used to impart bulk to a web. However, embossing of a dried web can result in disruption of bonds between fibers in the web. This disruption occurs because the bonds are formed and then set upon drying of the web. After the web is dried, moving fibers normal to the plane of the web disrupts fiber to fiber bonds, which in turn results in a web having less tensile strength than existed before embossing.

The following references disclose embossing: European Patent Application 0499942A2, U.S. Pat. No. 3,556,907, U.S. Pat. No. 3,867,225, U.S. Pat. No. 3,414,459, and U.S. Pat. No. 4,759,967.

As a result, paper scientists continue to search for improved paper structures that can be produced economically, and which provide increased strength without sacrificing softness and absorbency.

Accordingly, it is an object of the present invention to provide a method for dewatering and molding a paper web.

It is another object of the present invention to provide initial deflection of a portion of a paper web into an imprinting member, and subsequently pressing the resulting non-monoplanar web and the imprinting member between two deformable water receiving members.

Another object of the present invention is to provide a wet pressed paper web having increased strength for a given level of sheet flexibility.

Another object of the present invention is to provide a non-embossed patterned paper web having a relatively high density continuous network, a plurality of relatively low density domes dispersed throughout the continuous network, and a reduced thickness transition region at least partially encircling each of the low density domes.

SUMMARY OF THE INVENTION

The present invention provides a method for molding and dewatering a paper web. According to one embodiment of the present invention, an embryonic web of papermaking fibers is formed on a foraminous forming member, and transferred to an imprinting member to deflect a portion of the papermaking fibers in the embryonic web into deflection conduits in the imprinting member without densifying the embryonic web. The web and the imprinting member are then pressed between first and second dewatering felts in a compression nip to further deflect the papermaking fibers into the deflection conduits in the imprinting member and to remove water from both sides of the web. The molded structure of the web is preserved by preventing shearing of the web by the first dewatering felt in the nip, and by preventing rewetting of the web at the exit of the press nip. The present invention further provides a method for molding a wet paper web to have a continuous densified network by pressing the wet paper web between a dewatering felt and a foraminous imprinting member having a continuous network web imprinting surface.

The method according to the present invention can comprise the steps of providing the following: an aqueous dispersion of papermaking fibers; a foraminous forming member; a first dewatering felt; a second dewatering felt; a compression nip between first and second opposed surfaces; and a foraminous imprinting member having a first web contacting face and a second felt contacting face, the first face having a web imprinting surface and a deflection conduit portion. The method further comprises the steps of: forming an embryonic web of the papermaking fibers on the foraminous forming member; transferring the embryonic web from the foraminous forming member to the foraminous imprinting member; deflecting a portion of the papermaking fibers in the embryonic web into the deflection conduit portion of the first face of the imprinting member and removing water from the embryonic web through the deflection conduit portion to form an uncompacted, non-monoplanar intermediate web of papermaking fibers; positioning a face of the intermediate web adjacent the first face of the foraminous imprinting member; positioning the first dewatering felt adjacent another face of the intermediate web; positioning the second dewatering felt to be in flow communication with the deflection conduit portion; and pressing the intermediate web, the foraminous imprinting member, and the first and second dewatering felts in the compression nip to further deflect the papermaking fibers into the deflection conduit portion, to densify a portion of the intermediate web, and remove water from both faces of the intermediate web to form a molded web.

The paper structure according to the present invention comprises a non-embossed paper web having a first relatively high density region having a first thickness K, a second relatively low density region having a second thickness P, which is a local maxima, and which is greater than the first thickness K. The paper structure also has a third region extending intermediate the first and second regions. The third region comprises a transition region disposed adjacent the first region. The transition region has a third thickness T. The thickness T is a local minima, and is less than the thickness K. The paper structure has a measured thickness ratio P/K which is greater than 1.0, and a measured thickness ratio T/K which is less than 0.90. The paper web exhibits improved strength for a given level of flexibility.

In a preferred embodiment, the thickness ratio T/K is less than about 0.80, more preferably less than about 0.70, and most preferably less than about 0.65. The thickness ratio P/K is preferably at least about 1.5, more preferably at least about 1.7, and most preferably at least about 2.0.

In one embodiment the paper web has a first relatively high density, continuous network region, and a second relatively low density region comprising a plurality of discrete, relatively low density domes, or pillows, dispersed throughout the continuous network region, and disposed at an elevation different than that of the continuous network region. The relatively low density domes are isolated one from the other by the continuous network region. The third region extending intermediate the continuous network and each of the relatively low density domes comprises a transition region disposed adjacent the continuous network region and at least partially encircling each of the low density domes.

BRIEF DESCRIPTION OF THE DRAWINGS

While the specification concludes with claims particularly pointing out and distinctly claiming the present invention, the invention will be better understood from the following description taken in conjunction with the accompanying drawings in which like designations are used to designate substantially identical elements, and in which:

DETAILED DESCRIPTION OF THE INVENTION

Figure 1:
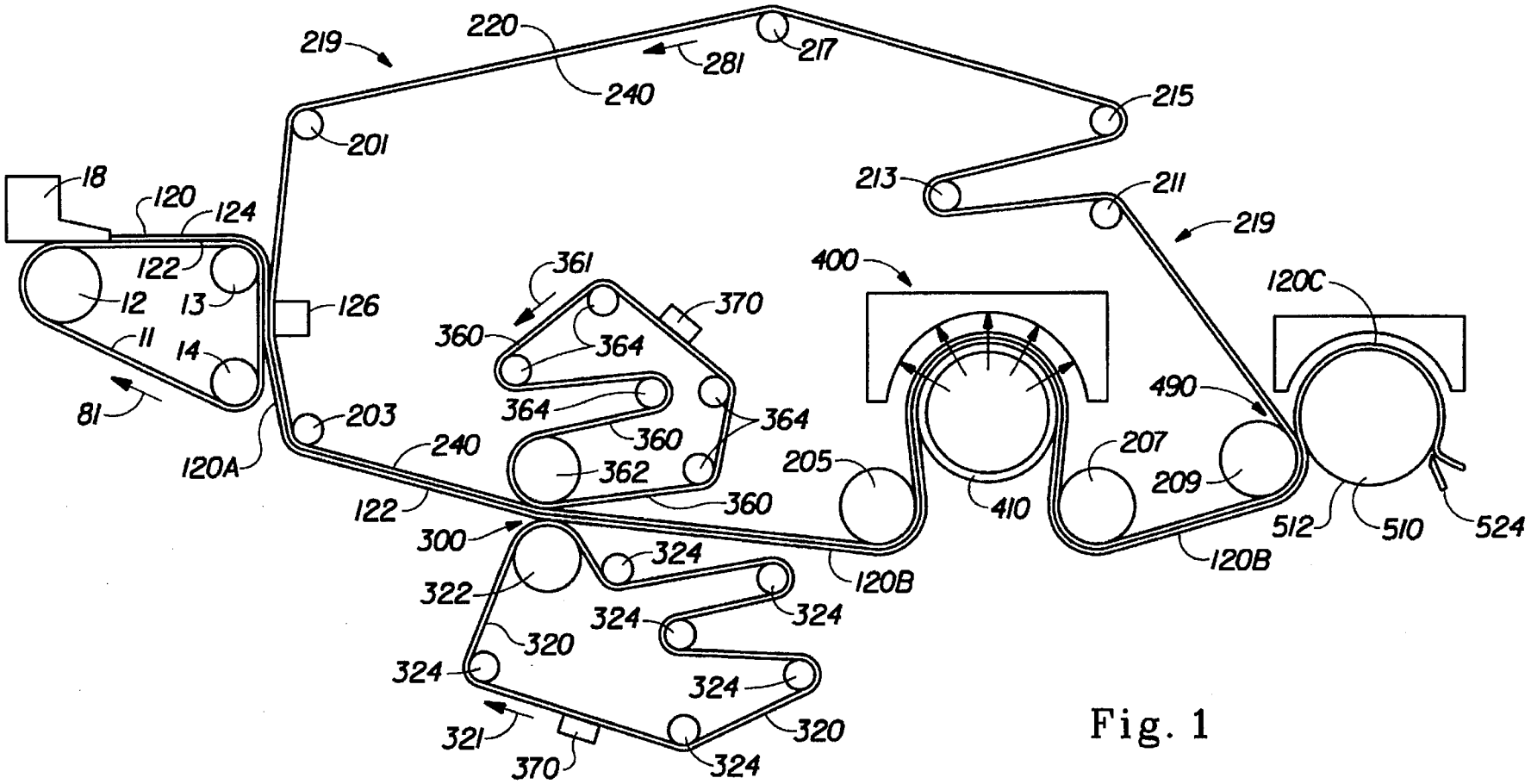
FIG. 1 is a schematic representation of one embodiment of a continuous papermaking machine which can be used to practice the present invention, and illustrating transferring a paper web from a foraminous forming member to a foraminous imprinting member, carrying the paper web on the foraminous imprinting member to a compression nip, and pressing the web carried on the foraminous imprinting member between first and second dewatering felts in the compression nip.

FIG. 1 illustrates one embodiment of a continuous papermaking machine which can be used in practicing the present invention. The process of the present invention comprises a number of steps or operations which occur in sequence. While the process of the present invention is preferably carried out in a continuous fashion, it will be understood that the present invention can comprise a batch operation, such as a handsheet making process. A preferred sequence of steps will be described, with the understanding that the scope of the present invention is determined with reference to the appended claims.

According to one embodiment of the present invention, an embryonic web 120 of papermaking fibers is formed from an aqueous dispersion of papermaking fibers on a foraminous forming member 11. The embryonic web 120 is then transferred to a foraminous imprinting member 219 having a first web contacting face 220 comprising a web imprinting surface and a deflection conduit portion. A portion of the papermaking fibers in the embryonic web 120 are deflected into deflection conduit portion of the foraminous imprinting member 219 without densifying the web, thereby forming an intermediate web 120A.

The intermediate web 120A is carried on the foraminous imprinting member 219 from the foraminous forming member 11 to a compression nip 300 formed by opposed compression surfaces on first and second nip rolls 322 and 362. A first dewatering felt 320 is positioned adjacent the intermediate web 120A, and a second dewatering felt 360 is positioned adjacent the foraminous imprinting member 219. The intermediate web 120A and the foraminous imprinting member 219 are then pressed between the first and second dewatering felts 320 and 360 in the compression nip 300 to further deflect a portion of the papermaking fibers into the deflection conduit portion of the imprinting member 219; to densify a portion of the intermediate web 120A associated with the web imprinting surface; and to further dewater the web by removing water from both sides of the web, thereby forming a molded web 120B which is relatively dryer than the intermediate web 120A.

The molded web 120B is carried from the compression nip 300 on the foraminous imprinting member 219. The molded web 120B can be pre-dried in a through air dryer 400 by directing heated air to pass first through the molded web, and then through the foraminous imprinting member 219, thereby further drying the molded web 120B. The web imprinting surface of the foraminous imprinting member 219 can then be impressed into the molded web 120B such as at a nip formed between a roll 209 and a dryer drum 510, thereby forming an imprinted web 120C. Impressing the web imprinting surface into the molded web can further densify the portions of the web associated with the web imprinting surface. The imprinted web 120C can then be dried on the dryer drum 510 and creped from the dryer drum by a doctor blade 524.

Examining the process steps according to the present invention in more detail, a first step in practicing the present invention is providing an aqueous dispersion of papermaking fibers derived from wood pulp to form the embryonic web 120. The papermaking fibers utilized for the present invention will normally include fibers derived from wood pulp. Other cellulosic fibrous pulp fibers, such as cotton linters, bagasse, etc., can be utilized and are intended to be within the scope of this invention. Synthetic fibers, such as rayon, polyethylene and polypropylene fibers, may also be utilized in combination with natural cellulosic fibers. One exemplary polyethylene fiber which may be utilized is Pulpex™, available from Hercules, Inc. (Wilmington, Del.). Applicable wood pulps include chemical pulps, such as Kraft, sulfite, and sulfate pulps, as well as mechanical pulps including, for example, groundwood, thermomechanical pulp and chemically modified thermomechanical pulp. Pulps derived from both deciduous trees (hereinafter, also referred to as "hardwood") and coniferous trees (hereinafter, also referred to as "softwood") may be utilized. Also applicable to the present invention are fibers derived from recycled paper, which may contain any or all of the above categories as well as other non-fibrous materials such as fillers and adhesives used to facilitate the original papermaking.

In addition to papermaking fibers, the papermaking furnish used to make tissue paper structures may have other components or materials added thereto as may be or later become known in the art. The types of additives desirable will be dependent upon the particular end use of the tissue sheet contemplated. For example, in products such as toilet paper, paper towels, facial tissues and other similar products, high wet strength is a desirable attribute. Thus, it is often desirable to add to the papermaking furnish chemical substances known in the art as "wet strength" resins.

A general dissertation on the types of wet strength resins utilized in the paper art can be found in TAPPI monograph series No. 29, Wet Strength in Paper and Paperboard, Technical Association of the Pulp and Paper Industry (New York, 1965). The most useful wet strength resins have generally been cationic in character. Polyamide-epichlorohydrin resins are cationic wet strength resins which have been found to be of particular utility. Suitable types of such resins are described in U.S. Pat. No. 3,700,623, issued on Oct. 24, 1972, and U.S. Pat. No. 3,772,076, issued on Nov. 13, 1973, both issued to Keim and both being hereby incorporated by reference. One commercial source of a useful polyamide-epichlorohydrin resins is Hercules, Inc. of Wilmington, Del., which markets such resin under the mark Kymeme™ 557H.

Polyacrylamide resins have also been found to be of utility as wet strength resins. These resins are described in U.S. Pat. No. 3,556,932, issued on Jan. 19, 1971, to Coscia, et at. and U.S. Pat. No. 3,556,933, issued on Jan. 19, 1971, to Williams et at., both patents being incorporated herein by reference. One commercial source of polyacrylamide resins is American Cyanamid Co. of Stanford, Conn., which markets one such resin under the mark Parez™631 NC.

Still other water-soluble cationic resins finding utility in this invention are urea formaldehyde and melamine formaldehyde resins. The more common functional groups of these polyfunctional resins are nitrogen containing groups such as amino groups and methylol groups attached to nitrogen. Polyethylenimine type resins may also find utility in the present invention. In addition, temporary wet strength resins such as Caldas 10 (manufactured by Japan Carlit) and CoBond 1000 (manufactured by National Starch and Chemical Company) may be used in the present invention. It is to be understood that the addition of chemical compounds such as the wet strength and temporary wet strength resins discussed above to the pulp furnish is optional and is not necessary for the practice of the present development.

The embryonic web 120 is preferably prepared from an aqueous dispersion of the papermaking fibers, though dispersions of the fibers in liquids other than water can be used. The fibers are dispersed in water to form an aqueous dispersion having a consistency of from about 0.1 to about 0.3 percent. The percent consistency of a dispersion, slurry, web, or other system is defined as 100 times the quotient obtained when the weight of dry fiber in the system under discussion is divided by the total weight of the system. Fiber weight is always expressed on the basis of bone dry fibers.

A second step in the practice of the present invention is forming the embryonic web 120 of papermaking fibers. Referring to FIG. 1, an aqueous dispersion of papermaking fibers is provided to a headbox 18 which can be of any convenient design. From the headbox 18 the aqueous dispersion of papermaking fibers is delivered to a foraminous forming member 11 to form an embryonic web 120. The forming member 11 can comprise a continuous Fourdrinier wire. Alternatively, the foraminous forming member 11 can comprise a plurality of polymeric protuberances joined to a continuous reinforcing structure to provide an embryonic web 120 having two or more distinct basis weight regions, such as is disclosed in U.S. Pat. No. 5,245,025 issued Sep. 14, 1993 to Trokhan et al, which patent is incorporated herein by reference. While a single forming member 11 is shown in FIG. 1, single or double wire forming apparatus may be used. Other forming wire configurations, such as S or C wrap configurations can be used.

The forming member 11 is supported by a breast roll 12 and plurality of return rolls, of which only two return rolls 13 and 14 are shown in FIG. 1. The forming member 11 is driven in the direction indicated by the arrow 81 by a drive means not shown. The embryonic web 120 is formed from the aqueous dispersion of papermaking fibers by depositing the dispersion onto the foraminous forming member 11 and removing a portion of the aqueous dispersing medium. The embryonic web 120 has a first web face 122 contacting the foraminous member 11 and a second oppositely facing web face 124.

The embryonic web 120 can be formed in a continuous papermaking process, as shown in FIG. 1, or alternatively, a batch process, such as a handsheet making process can be used. After the aqueous dispersion of papermaking fibers is deposited onto the foraminous forming member 11, the embryonic web 120 is formed by removal of a portion of the aqueous dispersing medium by techniques well known to those skilled in the art. Vacuum boxes, forming boards, hydrofoils, and the like are useful in effecting water removal from the aqueous dispersion on the foraminous forming member 11. The embryonic web 120 travels with the forming member 11 about the return roll 13 and is brought into the proximity of a foraminous imprinting member 219.

Figure 2:
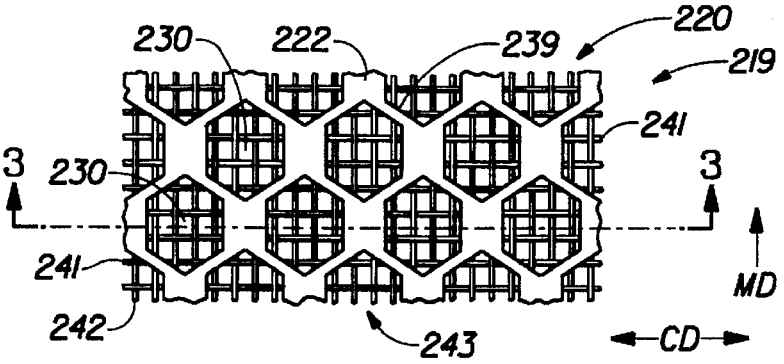
FIG. 2 is a schematic illustration of a plan view of a foraminous imprinting member having a first web contacting face comprising a macroscopically monoplanar, patterned continuous network web imprinting surface defining within the foraminous imprinting member a plurality of discrete, isolated, non connecting deflection conduits.
Figure 3:
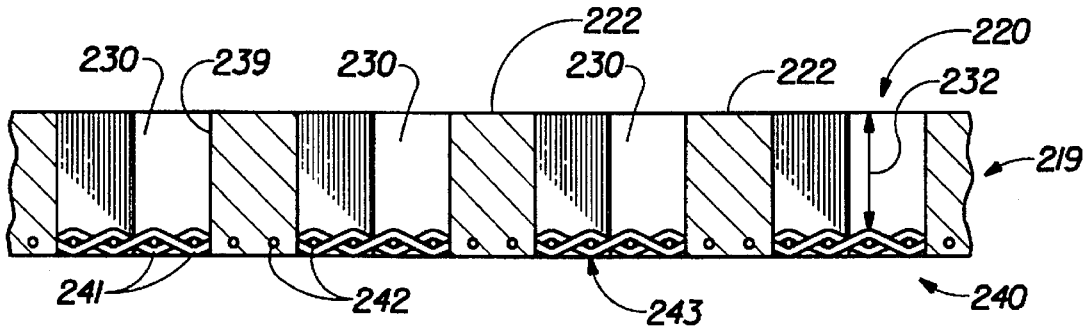
FIG. 3 is a cross-sectional view of a portion of the foraminous imprinting member shown in FIG. 2 as taken along line 3—3.

The foraminous imprinting member 219 has a first web contacting face 220 and a second felt contacting face 240. The web contacting face 220 has a web imprinting surface 222 and a deflection conduit portion 230, as shown in FIGS. 2 and 3. The deflection conduit portion 230 forms at least a portion of a continuous passageway extending from the first face 220 to the second face 240 for carrying water through the foraminous imprinting member 219. Accordingly, when water is removed from the web of papermaking fibers in the direction of the foraminous imprinting member 219, the water can be disposed of without having to again contact the web of papermaking fibers. The foraminous imprinting member 219 can comprise an endless belt, as shown in FIG. 1, and can be supported by a plurality of rolls 201–217. The foraminous imprinting member 219 is driven in the direction 281 shown in FIG. 1 by a drive means (not shown). The first web contacting face 220 of the foraminous imprinting member 219 can be sprayed with an emulsion comprising about 90 percent by weight water, about 8 percent petroleum oil, about 1 percent cetyl alcohol, and about 1 percent of a surfactant such as Adogen TA-100. Such an emulsion facilitates transfer of the web from the imprinting member 219 to the drying drum 510. Of course, it will be understood that the foraminous imprinting member 219 need not comprise an endless belt if used in making handsheets in a batch process.

In one embodiment the foraminous imprinting member 219 can comprise a fabric belt formed of woven filaments. The web imprinting surface 222 can be formed by discrete knuckles formed at the cross-over points of the woven filaments. Suitable woven filament fabric belts for use as the foraminous imprinting member 219 are disclosed in U.S. Pat. No. 3,301,746 issued Jan. 31, 1967 to Sanford et al., U.S. Pat. No. 3,905,863 issued Sep. 16, 1975 to Ayers, U.S. Pat. No. 4,191,609 issued Mar. 4, 1980 to Trokhan, and U.S. Pat. No. 4,239,065 issued Dec. 16, 1980 to Trokhan, which patents are incorporated herein by reference.

In another embodiment shown in FIGS. 2 and 3, the first web contacting face 220 of the foraminous imprinting member 219 comprises a macroscopically monoplanar, patterned, continuous network web imprinting surface 222. The continuous network web imprinting surface 222 defines within the foraminous imprinting member 219 a plurality of discrete, isolated, non-connecting deflection conduits 230. The deflection conduits 230 have openings 239 which can be random in shape and in distribution, but which are preferably of uniform shape and distributed in a repeating, preselected pattern on the first web contacting face 220. Such a continuous network web imprinting surface 222 and discrete deflection conduits 230 are useful for forming a paper structure having a continuous, relatively high density network region 1083 and a plurality of relatively low density domes 1084 dispersed throughout the continuous, relatively high density network region 1083, as shown in FIGS. 6 and 7.

Suitable shapes for the openings 239 include, but are not limited to, circles, ovals, and polygons, with hexagonal shaped openings 239 shown in FIG. 2. The openings 239 can be regularly and evenly spaced in aligned ranks and files. Alternatively, the openings 239 can be bilaterally staggered in the machine direction (MD) and cross-machine direction (CD), as shown in FIG. 2, where the machine direction refers to that direction which is parallel to the flow of the web through the equipment, and the cross machine direction is perpendicular to the machine direction. A foraminous imprinting member 219 having a continuous network web imprinting surface 222 and discrete isolated deflection conduits 230 can be manufactured according to the teachings of the following U.S. Patents which are incorporated herein by reference: U.S. Pat. No. 4,514,345 issued Apr. 30, 1985 to Johnson et al.; U.S. Pat. No. 4,529,480 issued Jul. 16, 1985 to Trokhan; and U.S. Pat. No. 5,098,522 issued Mar. 24, 1992 to Smurkoski et al.

Referring to FIGS. 2 and 3, the foraminous imprinting member 219 can include a woven reinforcement element 243 for strengthening the foraminous imprinting member 219. The reinforcement element 243 can include machine direction reinforcing strands 242 and cross machine direction reinforcing strands 241, though any convenient weave pattern can be used. The openings in the woven reinforcement element 243 formed by the interstices between the strands 241 and 242 are smaller than the size of the openings 239 of the deflection conduits 230. Together, the openings in the woven reinforcement element 243 and the openings 239 of the deflection conduits 230 provide a continuous passageway extending from the first face 220 to the second face 240 for carrying water through the foraminous imprinting member 219. The reinforcement element 243 can also provide a support surface for limiting deflection of the fibers into the deflection conduits 230, and thereby help to prevent the formation of apertures in the portions of the web associated with the deflection conduits 230, such as the relatively low density domes 1084. Such apertures, or pinholing, can be caused by water or air flow through the deflection conduits when a pressure difference exists across the web.

Figure 6:
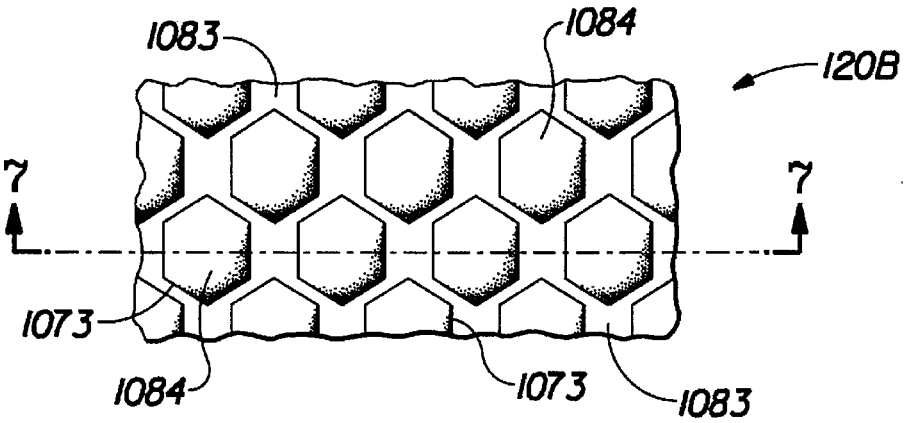
FIG. 6 is a schematic illustration of a plan view of a molded paper web formed using the foraminous imprinting member of FIGS. 2 and 3.
Figure 7:
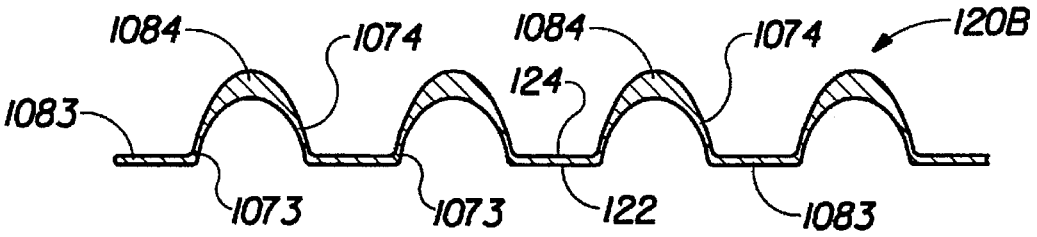
FIG. 7 is a schematic cross-sectional illustration of the paper web of FIG. 6 taken along line 7—7 of FIG. 6.

The area of the web imprinting surface 222, as a percentage of the total area of the first web contacting surface 220, should be between about 15 percent to about 65 percent, and more preferably between about 20 percent to about 50 percent to provide a desirable ratio of the areas of the relatively high density region 1083 and the relatively low density domes 1084 shown in FIGS. 6 and 7. The size of the openings 239 of the deflection conduits 230 in the plane of the first face 220 can be expressed in terms of effective free span. Effective free span is defined as the area of the opening 239 in the plane of the first face 220 divided by one fourth of the perimeter of the opening 239. The effective free span should be from about 0.25 to about 3.0 times the average length of the papermaking fibers used to form the embryonic web 120, and is preferably from about 0.5 to about 1.5 times the average length of the papermaking fibers. The deflection conduits 230 can have a depth 232 (FIG. 3) which is between about 0.1 mm and about 1.0 mm.

Figure 5:
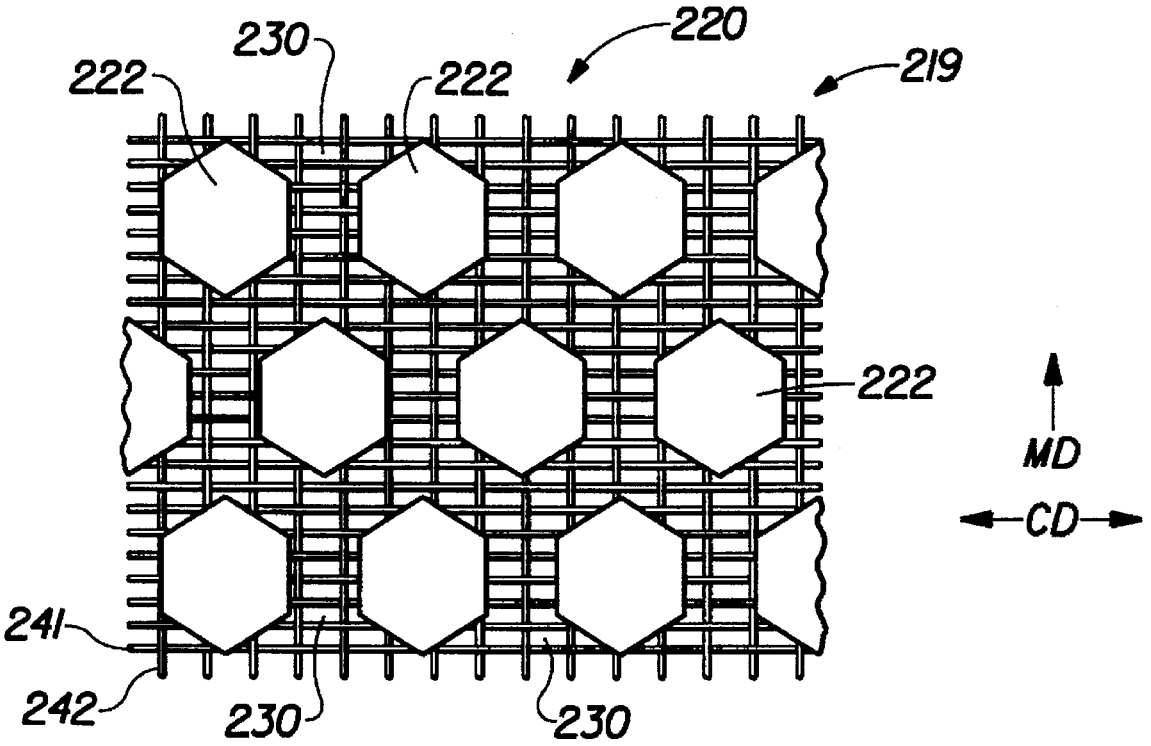
FIG. 5 is a schematic illustration of a plan view of a foraminous imprinting member having a web contacting face comprising a continuous, patterned deflection conduit defining a plurality of discrete, isolated web imprinting surfaces.

In another embodiment shown in FIG. 5, the foraminous imprinting member 219 can have a first web contacting face 220 comprising a continuous patterned deflection conduit 230 encompassing a plurality of discrete, isolated web imprinting surfaces 222. The foraminous imprinting member 219 shown in FIG. 5 can be used to form a molded web having a continuous, relatively low density network region, and a plurality of discrete, relatively high density regions dispersed throughout the continuous, relatively low density network. A foraminous imprinting member 219 such as that shown in FIG. 5 can be made according to the teachings of U.S. Pat. No. 4,514,345 issued Apr. 30, 1985 to Johnson et al., which patent is incorporated herein by reference.

Figure 9:
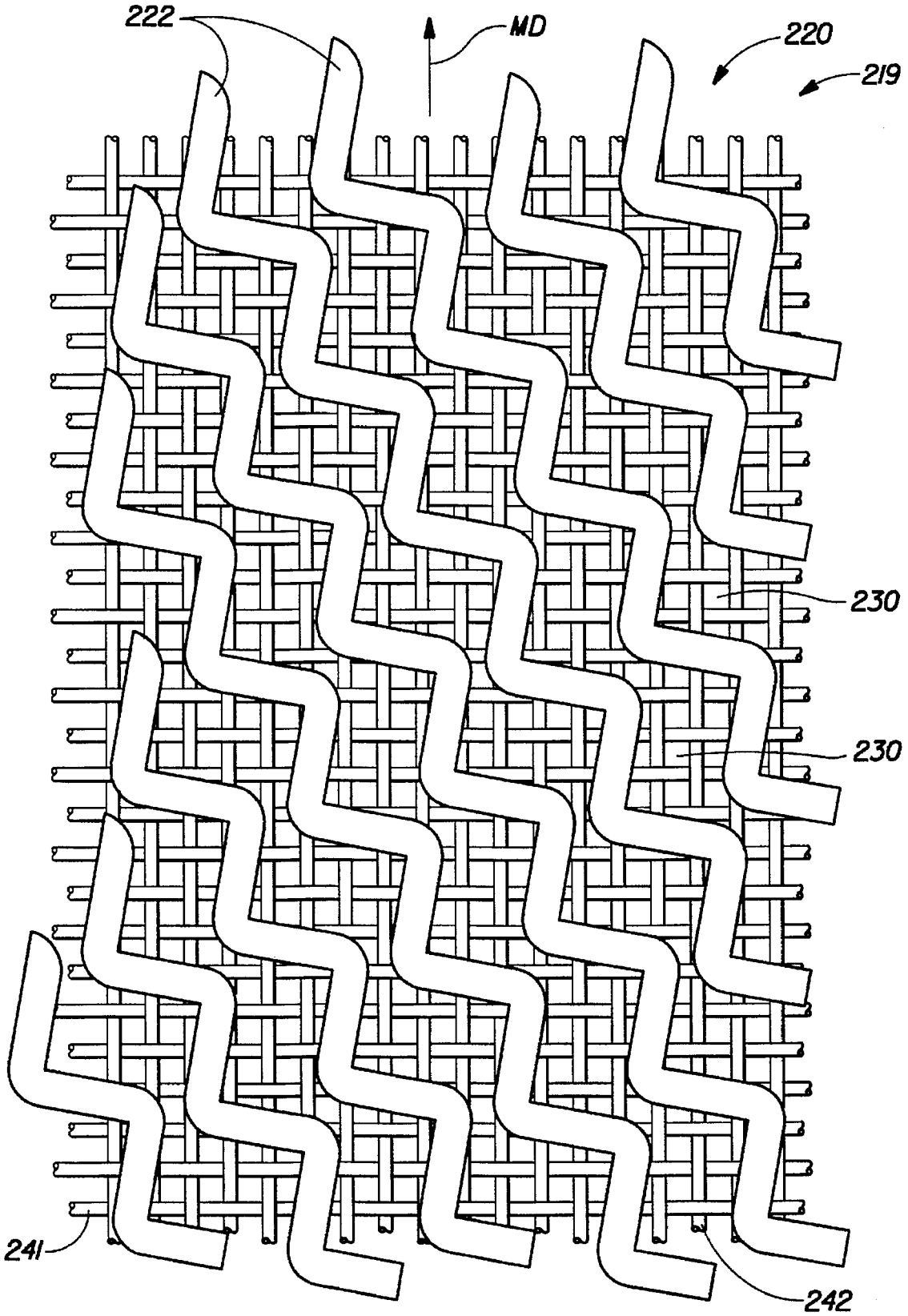
FIG. 9 is a schematic illustration of a foraminous imprinting member having a semi-continuous web imprinting surface.

In yet another embodiment shown in FIG. 9, foraminous imprinting member 219 can have a first web contacting face 220 comprising a plurality of semicontinuous web imprinting surfaces 222. As used herein, a pattern of web imprinting surfaces 222 is considered to be semicontinuous if a plurality of the imprinting surfaces 222 extend substantially unbroken along any one direction on the web contacting face 220, and each imprinting surface is spaced apart from adjacent imprinting surfaces 220 by a deflection conduit 230. The web contacting face 220 shown in FIG. 9 has adjacent semicontinuous imprinting surfaces 222 spaced apart by semicontinuous deflection conduits 230. The semicontinuous imprinting surfaces 222 can extend generally parallel to the machine or cross-machine directions, or alternatively, extend along a direction forming an angle with respect to the machine and cross-machine directions, as shown in FIG. 9. U.S. patent application Ser. No. 07/936,954, Papermaking Belt Having Semicontinuous Pattern and Paper Made Thereon, filed Aug. 26, 1992 in the name of Ayers et al. is incorporated herein by reference for the purpose of disclosing a belt having a semi-continuous pattern.

A third step in the practice of the present invention comprises transferring the embryonic web 120 from the foraminous forming member 11 to the foraminous imprinting member 219, to position the second web face 124 on the first web contacting face 220 of the foraminous imprinting member 219. A fourth step in the practice of the present invention comprises deflecting a portion of the papermaking fibers in the embryonic web 120 into the deflection conduit portion 230 of web contacting face 220, and removing water from the embryonic web 120 through the deflection conduit portion 230 to form an intermediate web 120A of the papermaking fibers. The embryonic web 120 preferably has a consistency of between about 10 and about 20 percent at the point of transfer to facilitate deflection of the papermaking fibers into the deflection conduit portion 230.

The steps of transferring the embryonic web 120 to the imprinting member 219 and deflecting a portion of the papermaking fibers in the web 120 into the deflection conduit portion 230 can be provided, at least in part, by applying a differential fluid pressure to the embryonic web 120. For instance, the embryonic web 120 can be vacuum transferred from the forming member 11 to the imprinting member 219, such as by a vacuum box 126 shown in FIG. 1, or alternatively, by a rotary pickup vacuum roll (not shown). The pressure differential across the embryonic web 120 provided by the vacuum source (e.g. the vacuum box 126) deflects the fibers into the deflection conduit portion 230, and preferably removes water from the web through the deflection conduit portion 230 to raise the consistency of the web to between about 18 and about 30 percent. The pressure differential across the embryonic web 120 can be between about 13.5 kPa and about 40.6 kPa (between about 4 to about 12 inches of mercury). The vacuum provided by the vacuum box 126 permits transfer of the embryonic web 120 to the foraminous imprinting member 219 and deflection of the fibers into the deflection conduit portion 230 without compacting the embryonic web 120. Additional vacuum boxes (not shown) can be included to further dewater the intermediate web 120A.

Figure 4:
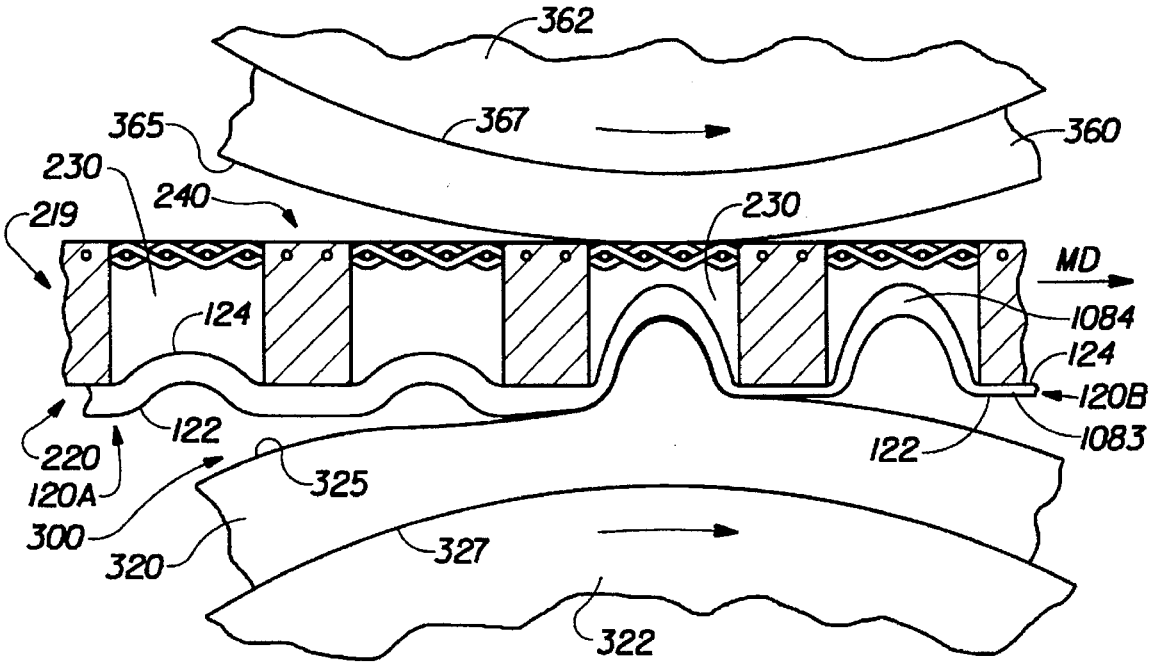
FIG. 4 is an enlarged schematic illustration of the compression nip shown in FIG. 1, showing a first dewatering felt positioned adjacent a first face of the web, the web contacting face of the foraminous imprinting member positioned adjacent the second face of the web, and a second dewatering felt positioned adjacent the second felt contacting face of the foraminous imprinting member, wherein the foraminous imprinting member, felts, and paper web are enlarged relative to the rolls of the compression nip.

Referring to FIG. 4, portions of the intermediate web 120A are shown deflected into the deflection conduits 230 upstream of the compression nip 300, so that the intermediate web 120A is non-monoplanar. The intermediate web 120A is shown having a generally uniform thickness (distance between first and second web faces 122 and 124) upstream of the compression nip 300 to indicate that a portion of the intermediate web 120A has been deflected into the imprinting member 219 without locally densifying or compacting the intermediate web 120A upstream of the compression nip 300. Transfer of the embryonic web 120 and deflection of the fibers in the embryonic web into the deflection conduit portion 230 can be accomplished essentially simultaneously. Above referenced U.S. Pat. No. 4,529,480 is incorporated herein by reference for the purpose of teaching a method for transferring an embryonic web to a foraminous member and deflecting a portion of the papermaking fibers in the embryonic web into the foraminous member.

A fifth step in the practice of the present invention comprises pressing the wet intermediate web 120A in the compression nip 300 to form the molded web 120B. Referring to FIGS. 1 and 4, the intermediate web 120A is carried on the foraminous imprinting member 219 from the foraminous forming member 11 and through the compression nip 300 formed between opposed compression surfaces on nip rolls 322 and 362. The first dewatering felt 320 is shown supported in the compression nip by the nip roll 322 and driven in the direction 321 around a plurality of felt support rolls 324. Similarly, the second dewatering felt 360 is shown supported in the compression nip 300 by the nip roll 362 and driven in the direction 361 around a plurality of felt support rolls 364. A felt dewatering apparatus 370, such as a Uhle vacuum box can be associated with each of the dewatering felts 320 and 360 to remove water transferred to the dewatering felts from the intermediate web 120A.

The nip rolls 322 and 362 can have generally smooth opposed compression surfaces, or alternatively, the rolls 322 and 362 can be grooved. In an alternative embodiment (not shown) the nip rolls can comprise vacuum rolls having perforated surfaces for facilitating water removal from the intermediate web 120A. The rolls 322 and 362 can have rubber coated opposed compression surfaces, or alternatively, a rubber belt can be disposed intermediate each nip roll and its associated dewatering felt. The nip rolls 322 and 362 can comprise solid rolls having a smooth, bonehard rubber cover, or alternatively, one or both of the rolls 322 and 362 can comprise a grooved roll having a bonehard rubber cover.

In order to describe the operation of the compression nip 300, the imprinting member 219, dewatering felts 320 and 360, and the paper web are drawn enlarged relative to the rolls 322 and 362 in FIG. 4. While only one deflection conduit 230 is shown along the machine direction of the nip 300 in FIG. 4, it will be understood multiple deflection conduits will be present in the nip along the machine direction at any given instant of time.

The term "dewatering felt" as used herein refers to a member which is absorbent, compressible, and flexible so that it is deformable to follow the contour of the non-monoplanar intermediate web 120A on the imprinting member 219, and capable of receiving and containing water pressed from an intermediate web 120A. The dewatering felts 320 and 360 can be formed of natural materials, synthetic materials, or combinations thereof.

The dewatering felts 320 and 360 can have a thickness of between about 2 mm to about 5 mm, a basis weight of about 800 to about 2000 grams per square meter, an average density (basis weight divided by thickness) of between about 0.35 gram per cubic centimeter and about 0.45 gram per cubic centimeter, and an air permeability of between about 15 and about 110 cubic feet per minute per square foot, at a pressure differential across the dewatering felt thickness of 0.12 kPa (0.5 inch of water). The dewatering felt 320 preferably has first surface 325 having a relatively high density, relatively small pore size, and a second surface 327 having a relatively low density, relatively large pore size. Likewise, the dewatering felt 360 preferably has a first surface 365 having a relatively high density, relatively small pore size, and a second surface 367 having a relatively low density, relatively large pore size. The relatively high density and relatively small pore size of the first felt surfaces 325, 365 promote rapid acquisition of the water pressed from the web in the nip 300. The relatively low density and relatively large pore size of the second felt surfaces 327, 367 provide space within the dewatering felts for storing water pressed from the web in the nip 300.

The dewatering felts 320 and 360 should have a compressibility of between 20 and 80 percent, preferably between 30 and 70 percent, and more preferably between 40 and 60 percent. The "compressibility" as used herein is a measure of the percentage change in thickness of the dewatering felt under a given loading defined below. The dewatering felts 320 and 360 should also have a modulus of compression less than 10000 psi, preferably less than 7000 psi, more preferably less than 5000 psi, and most preferably between about 1000 and about 4000 psi. The "modulus of compression" as used herein is a measure of the rate of change of loading with change in thickness of the dewatering felt. The compressibility and modulus of compression are measured using the following procedure. The dewatering felt is placed on a papermaking fabric formed of woven polyester monofilaments having a diameter of about 0.40 millimeter and having a square weave pattern of about 36 filaments per inch in a first direction, and about 30 filaments per inch in a second direction perpendicular to the first direction. The papermaking fabric has thickness under no compressive loading of about 0.68 millimeter (0.027 inch). Such a papermaking fabric is commercially available from the Appleton Wire Company of Appleton, Wis. The dewatering felt is positioned so that the surface of the dewatering felt which is normally in contact with the paper web is adjacent the papermaking fabric. The felt-fabric pair is then compressed with a constant rate tensile/compression tester, such as an Instron Model 4502 available from the Instron Engineering Corporation of Canton, Mass. The tester has a circular compression foot having a surface area of about 13 square centimeters (2.0 square inches) attached to a crosshead moving at a rate of 5.08 centimeters per minute (2.0 inch per minute). The thickness of the felt-fabric pair is measured at loads of 0 psi, 300 psi, 450 psi, and 600 psi, where the load in psi is calculated by dividing the load in pounds obtained from the tester load cell by the surface area of the compression foot. The thickness of the fabric alone is also measured at 0 psi, 300 psi, 450 psi, and 600 psi loads. The compressibility and modulus of compression in psi are calculated using the following equations:

$$\text{Compressibility}=100\times((TFP0-TP0)-(TFP450-TP450))/(TFP0-TP0)$$

$$\text{Modulus of Compression}=(300\text{ psi})\times(TFP300-TP300)/((TFP300-TP300)-(TFP600-TP600)$$

where TFP0, TFP300, TFP450, and TFP600 are the thicknesses of the felt-fabric pair at 0 psi, 300 psi, 450 psi and 600 psi loads, respectively, and TP0, TP300, TP450, and TP600 are the thicknesses of the fabric alone at 0 psi, 300 psi, 450 psi, and 600 psi loads, respectively. Suitable dewatering felts 320 and 360 are commercially available as SUPERFINE DURAMESH, style XY31620 from the Albany International Company of Albany, N.Y.

The intermediate web 120A and the web imprinting surface 222 are positioned intermediate the first and second felt layers 320 and 360 in the compression nip 300. The first felt layer 320 is positioned adjacent the first face 122 of the intermediate web 120A. The web imprinting surface 222 is positioned adjacent the second face 124 of the web 120A. The second felt layer 360 is positioned in the compression nip 300 such that the second felt layer 360 is in flow communication with the deflection conduit portion 230.

Referring to FIGS. 1 and 4, The first surface 325 of the first dewatering felt 320 is positioned adjacent the first face 122 of the intermediate web 120A as the first dewatering felt 320 is driven around the nip roll 322. Similarly, the first surface 365 of the second dewatering felt 360 is positioned adjacent the second felt contacting face 240 of the foraminous imprinting member 219 as the second dewatering felt 360 is driven around the nip roll 362. Accordingly, as the intermediate web 120A is carried through the compression nip 300 on the foraminous imprinting fabric 219, the intermediate web 120A, the imprinting fabric 219, and the first and second dewatering felts 320 and 360 are pressed together between the opposed surfaces of the nip rolls 322 and 362. Pressing the intermediate web 120A in the compression nip 300 further deflects the paper making fibers into the deflection conduit portion 230 of the imprinting member 219, and removes water from the intermediate web 120A to form the molded web 120B. The water removed from the web is received by and contained in the dewatering felts 320 and 360. Water is received by the dewatering felt 360 through the deflection conduit portion 230 of the imprinting member 219.

The intermediate web 120A should have a consistency of between about 14 and about 80 percent at the entrance to the compression nip 300. More preferably, the intermediate web 120A has a consistency between about 15 and about 35 percent at the entrance to the nip 300. The papermaking fibers in an intermediate web 120A having such a preferred consistency have relatively few fiber to fiber bonds, and can be relatively easily rearranged and deflected into the deflection conduit portion 230 by the first dewatering felt 320.

The intermediate web 120A is preferably pressed in the compression nip 300 at a nip pressure of at least 100 pounds per square inch (psi), and more preferably at least 200 psi. In a preferred embodiment, the intermediate web 120A is pressed in the compression nip 300 at a nip pressure between about 200 pounds per square inch and about 1000 pounds per square inch. It is desirable to specify the nip pressure in pounds per square inch, rather than the nip force in pounds per lineal inch (pli), because a nip force measurement in pli does not take into account the width of the nip 300, as measured in the machine direction (MD in FIG. 4). The width of the nip 300 can vary depending upon the properties of the dewatering felts 320, 360 and the imprinting member 219, as well as surface hardness of the compression rolls 322 and 362. Accordingly, a measurement of nip force in pounds per lineal inch does not provide a measurement of nip pressure, and in fact, two different compression nips can have the same nip force as measured in pounds per lineal inch, but different nip pressures as measured in pounds per square inch.

The nip pressure in psi is calculated by dividing the radial force exerted on the web by the nip rolls 322 and 362 (nip rolls 322 and 362 exert an equal and opposite radial force on the web) by the area of the nip 300. The radial force exerted by the nip rolls 322 and 362 can be calculated using various force or pressure transducers familiar to those skilled in the art. For instance, where the nip rolls 322 and 326 are hydraulically actuated, the pressure in the nip roll hydraulic system when the rolls 322 and 326 are engaged can be used to calculate the radial force exerted by the nip rolls 322 and 362 on the web. The area of nip 300 is measured using a sheet of carbon paper and a sheet of plain white paper, each having a length greater than or equal to the length of the rolls 322 and 362. The carbon paper is placed on the sheet of plain paper. The carbon paper and the sheet of plain paper are placed in the compression nip 300 with the first and second dewatering felts 320, 360 and the imprinting member 219. The carbon paper is positioned adjacent the first dewatering felt 320 and the plain paper is positioned adjacent the imprinting member 219. The nip rolls 322 and 362 are then engaged to provide the desired radial force, and the area of the nip 300 at that level of radial force is measured from the imprint that the carbon paper imparts to the sheet of plain white paper.

The molded web 120B is preferably pressed to have a consistency of at least about 30 percent at the exit of the compression nip 300. Pressing the intermediate web 120A as shown in FIG. 1 molds the web to provide a first relatively high density region 1083 associated with the web imprinting surface 222 and a second relatively low density region 1084 of the web associated with the deflection conduit portion 230. Pressing the intermediate web 120A on an imprinting fabric 219 having a macroscopically monoplanar, patterned, continuous network web imprinting surface 222, as shown in FIGS. 2–4, provides a molded web 120B having a macroscopically monoplanar, patterned, continuous network region 1083 having a relatively high density, and a plurality of discrete, relatively low density domes 1084 dispersed throughout the continuous, relatively high density network region 1083. Such a molded web 120B is shown in FIGS. 6 and 7. Such a molded web has the advantage that the continuous, relatively high density network region 1083 provides a continuous loadpath for carrying tensile loads.

The molded web 120B is also characterized in having a third intermediate density region 1074 extending intermediate the first and second regions 1083 and 1084. The third region 1074 comprises a transition region 1073 positioned adjacent the first relatively high density region 1083. The intermediate density region 1074 is formed as the first dewatering felt 320 draws papermaking fibers into the deflection conduit portion 230, and has a tapered, generally trapezoidal cross-section. The transition region 1073 is formed by compaction of the intermediate web 120A at the perimeter of the deflection conduit portion 230, and encloses the intermediate density region 1074 to at least partially encircle each of the relatively low density domes 1084. The transition region 1073 is characterized in having a thickness T which is a local minima, and which is less than the thickness K of the relatively high density region 1083, and a local density which is greater than the density of the relatively high density region 1083. The relatively low density domes 1084 have a thickness P which is a local maxima, and which is greater than the thickness K of the relatively high density, continuous network region 1083. Without being limited by theory, it is believed that the transition region 1073 acts as a hinge which enhances web flexibility.

In FIGS. 6–7, each intermediate density region 1074 extends intermediate the relatively high density network 1083 and a relatively low density dome 1084, and each intermediate density region 1074 encloses a relatively low density dome 1084. In an alternative embodiment, a web pressed with the imprinting fabric 219 shown in FIG. 5 has a continuous relatively low density region 1084, a plurality of discrete, relatively high density regions 1083 dispersed throughout the relatively low density region 1084, and a plurality of intermediate density regions 1074. Each intermediate density region 1074 extends intermediate the continuous, relatively low density region 1084 and a relatively high density region 1083 to enclose the relatively high density region 1083, and a transition region 1073 encloses each intermediate density region 1074.

Figure 8:
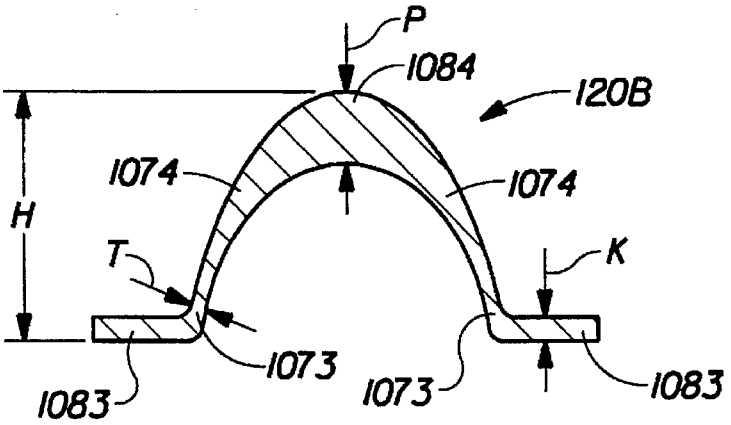
FIG. 8 is an enlarged view of the cross-section of the paper web shown in FIG. 7.

The molded web 120B formed by the process shown in FIG. 1 is characterized in having relatively high tensile strength and flexibility for a given level of web basis weight and web caliper H (FIG. 8). This relatively high tensile strength and flexibility is believed to be due, at least in part, to the difference in density between the relatively high density region 1083 and the relatively low density region 1084. Web strength is enhanced by pressing a portion of the intermediate web 120A between the first dewatering felt 320 and the web imprinting surface 220 to form the relatively high density region 1083. Simultaneously compacting and dewatering a portion of the web provides fiber to fiber bonds in the relatively high density region for carrying loads. Pressing also forms the transition region 1073, which provides web flexibility. The relatively low density region 1084 deflected into the deflection conduit portion 230 of the imprinting member 219 provides bulk for enhancing absorbency. In addition, pressing the intermediate web 120A draws papermaking fibers into the deflection conduit portion 230 to form the intermediate density region 1074, thereby increasing the web macro-caliper H (FIG. 8). Increased web caliper H decreases the web's apparent density (web basis weight divided by web caliper H). Web flexibility increases as web stiffness decreases.

Paper webs made according to the present invention can have a total tensile strength TT (maximum strength normalized by basis weight) which is at least about 15 percent greater than that of a corresponding unpressed base web (a web made with the same furnish and imprinting member 219, but without pressing in a nip 300 between two felt layers). The total tensile strength of the web made according to the present invention can be at least about 300 meters. Paper webs made according to the present invention can have a normalized stiffness index which is at least about 15 percent less than that of a corresponding unpressed base web. The normalized stiffness index TS/TT of a web made according to the present invention can be less than about 10. In one embodiment, a paper web made according to the present invention has a total tensile strength TT of at least about 1600 meters and a normalized stiffness index TS/TT of less than about 5.5. Paper webs made according to the present invention can have a macro-caliper H of at least about 0.10 mm. In one embodiment, paper webs made according to the present invention have a macro-caliper of at least about 0.20 mm, and more preferably at least about 0.30 mm. The normalized stiffness index TS/TT is a measure of the stiffness of the web normalized to the total tensile strength of the web. The procedure for measuring the normalized tensile strength, normalized stiffness index, and macro-caliper H are described below.

The difference in density between the relatively high density region 1083 and the relatively low density region 1084 is provided, in part, by deflecting a portion of the embryonic web 120 into the deflection conduit portion 230 of the imprinting member 219 to provide a non-monoplanar intermediate web 120A upstream of the compression nip 300. A monoplanar web carried through the compression nip 300 would be subject to some uniform compaction, thereby increasing the minimum density in the molded web 120B. The portions of the non-monoplanar intermediate web 120A in the deflection conduit portion 230 avoid such uniform compaction, and therefore maintain a relatively low density.

The difference in density between the relatively high density region and the relatively low density region is also provided, in part, by pressing with both the first and second dewatering felts 320 and 360 to remove water from both faces of the web and prevent rewetting of the web. Water is expelled from the first and second web faces 122 and 124 as the intermediate web 120A is pressed in the compression nip 300. It is important that the water expelled from both faces of the web be removed from both faces of the web. Otherwise, the expelled water can re-enter the molded web 120B at the exit of the nip 300. For instance, if the dewatering felt 360 is omitted, water expelled from the second web face 124 into the deflection conduit portion 230 can re-enter the molded web 120B through the deflection conduit portion 230 of the imprinting member 219 at the exit of the nip 300.

Re-entry of water into the molded web 120B is undesirable because it decreases the consistency of the molded web 120B, and reduces drying efficiency. In addition, re-entry of water into the molded web 120B disrupts the fiber bonds formed during pressing of the intermediate web 120A and de-densities the web. In particular, water returning to the molded web 120B will disrupt the bonds in the relatively high density region 1083, and reduce the density and load carrying capability of that region. Water returning to the molded web 120B can also disrupt the fiber bonds forming the transition region 1073.

The dewatering felts 320 and 360 prevent rewetting of the molded web through both web faces 122 and 124, and thereby help to maintain the relatively high density region 1083 and the transition region 1073. In some embodiments it can be desirable to remove the first dewatering felt 320 from the first face 122 of the molded web 120B at the exit of the compression nip 300 to prevent water held in the dewatering felt 320 from rewetting the first face 122 of the web. Similarly, it can be desirable to remove the second dewatering felt 360 from the imprinting member 219 at the nip exit to prevent water held in the dewatering felt 360 from re-entering the web through the deflection conduit portion 230. In the embodiment shown in FIGS. 1 and 4, the first and second dewatering felts 320 and 360 can be supported by the rollers 324 and 364 to follow the opposed compression surfaces of the nip rollers 322 and 362, respectively, so that the dewatering felts do not contact the molded web 120B or the imprinting member 219 downstream of the exit of the compression nip 300.

Applicants have found that there are a number of advantages in pressing in a nip comprising the two dewatering felts 320 and 360, rather than in a nip having just one dewatering felt, such as dewatering felt 320, or in a nip having just one dewatering felt 320, with the nip roll 322 comprising a vacuum roll with an apertured surface. Vacuum rolls are structurally weaker than solid rolls, and therefore limit the ability to press at high nip pressures. The apertured surface of vacuum rolls can also induce irregular pressing of the web (e.g. reduced pressing of the web at locations corresponding to the area of the apertures in the vacuum roll surface), and can result in localized rewetting of the web at locations spaced from the apertures. More importantly, water removal with a vacuum roll is dependent on the time the web spends in the nip. As the web speed is increased to provide more economical paper machine production, the vacuum time in the nip decreases, thereby reducing the vacuum rolls effectiveness in dewatering the web. In particular, applicants have found that when only a single dewatering felt is associated with a nip having a vacuum roll, water removal from the web decreases as the web speed is increased, and at higher web speeds water removal will actually decrease with increasing nip pressure. In contrast, when two dewatering felts are used, water removal from the web will increase with both increasing nip pressure and higher web speeds, without requiring the use of a vacuum roll.

Figure 10:
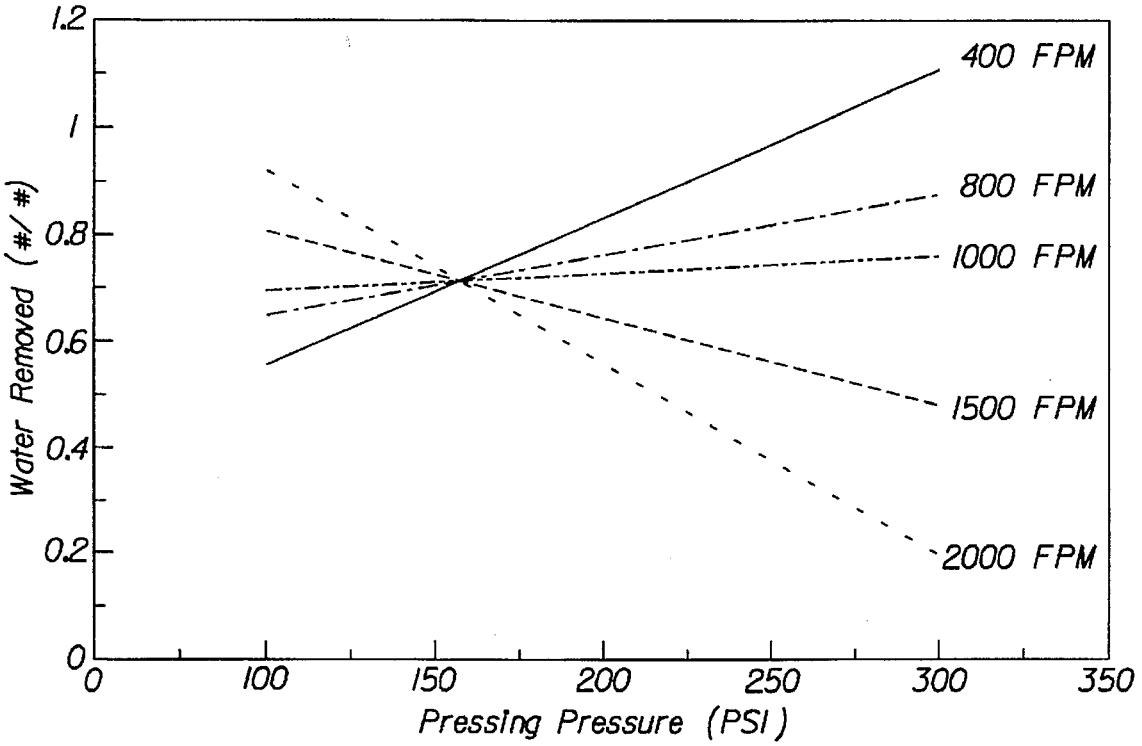
FIG. 10 is a graph of water removal from a web versus nip pressure at different web speeds, for a web and imprinting member pressed in a press nip, the press nip having a single dewatering felt adjacent the web, a vacuum roll adjacent the felt, and a solid roll adjacent the imprinting member.
Figure 11:
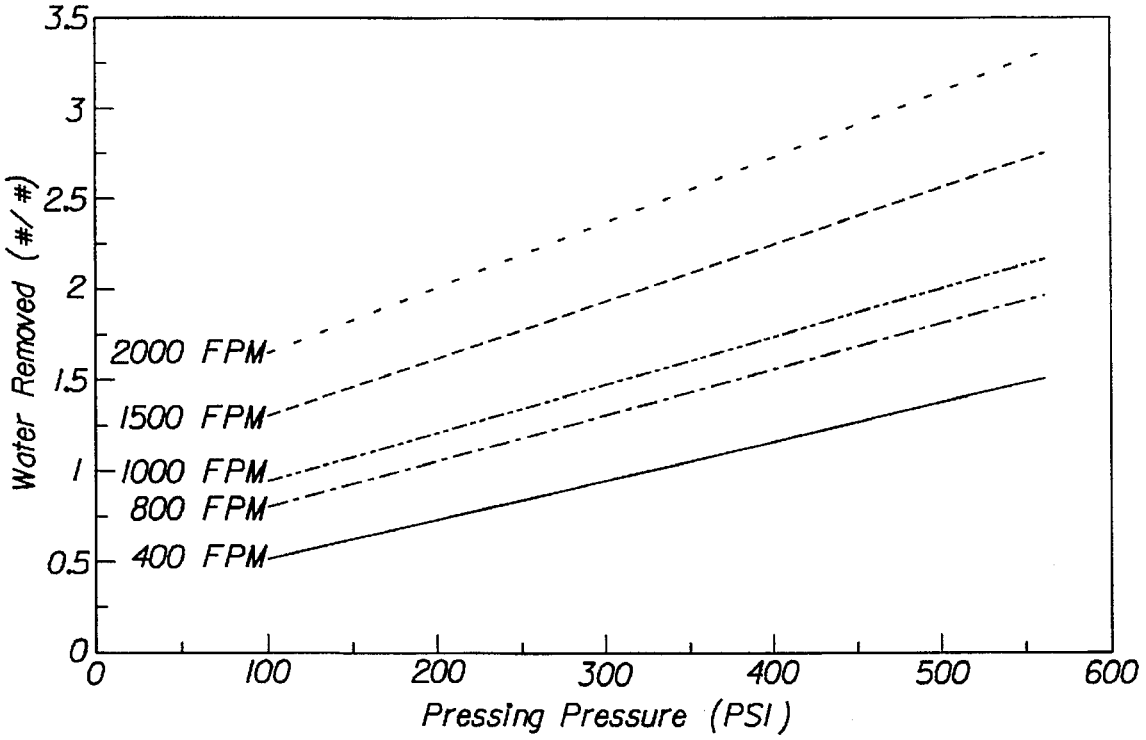
FIG. 11 is a graph of water removal from a web versus nip pressure at different web speeds, for a web and imprinting member pressed between two dewatering felts in the press nip.

The graphs in FIGS. 10 and 11 illustrates this increase in water removal obtained by pressing the web and imprinting member between two dewatering felts. FIG. 10 shows water removal from the web (pounds of water removed per pound of dry fiber in the web) as a function of nip pressure in psi for constant web speeds of 400 to 2000 fpm (feet per minute). The graphs in FIGS. 10 and 11 were obtained from data taken at web speeds of 400, 800 and 2000 fpm. The 1000 and 1500 fpm lines in FIGS. 10 and 11 were interpolated from the data taken at 400, 800, and 2000 fpm web speed. Web speed corresponds to the speed of the web in the machine direction MD shown in FIG. 4. The data in FIG. 10 were obtained with nip having the web positioned between a dewatering felt and an imprinting member, and with a solid nip roll adjacent the imprinting member and a vacuum roll adjacent the dewatering felt. FIG. 10 illustrates that the water removal from the web decreases as the web speed increases, and more particularly, at web speeds above about 800 feet per minute, the rate of water removal from the web decreases as the nip pressure is increased. Therefore, web molding with a single dewatering felt nip imposes both speed and nip pressure limitations for a given level of desired water removal from the web.

The data in FIG. 11 were obtained with the nip arrangement shown in FIG. 4, with the web and imprinting member positioned between two dewatering felts, and with a solid nip roll 362 and a grooved nip roll 322. The dewatering felt and imprinting member used to obtain the data in FIG. 11 were the same as those used to obtain the data in FIG. 10. FIG. 11 illustrates that the water removal from the web increases as web speed is increased. FIG. 11 also illustrates that water removal from the web increases as nip pressure increases, regardless of the web speed. Therefore, molding the web by pressing with two dewatering felts does not require a compromise between water removal, web speed, and nip pressure. Increased water removal implies less rewetting of the web, so that fiber to fiber bonds are maintained and paper machine drying efficiency is improved. Increased web speed provides more economical paper production. Increased pressing pressure helps to further densify the relatively high density region 1083 shown in FIG. 4, thereby improving the tensile strength of the molded web.

Without being limited by theory, it is believed that a nip having a single dewatering felt has reduced water removing capability at higher web speeds because rewetting of the web at the exit of the press nip will increase with higher web speeds in such a nip. A vacuum is generated at the exit of a press nip, as is known in the art. This vacuum is created, at least in part, by the rapid separation of the press roll surfaces at the nip exit. The vacuum caused by the separation of the press roll surfaces increases with the square of the velocity of the surface of the press rolls, as is discussed in the following articles which are incorporated herein by reference: Drainage at a Table Roll, Taylor, Pulp and Paper Magazine of Canada, Convention Issue 1956, pp 267—276; and Drainage at a Table Roll and a Foil, Taylor, Pulp and Paper Magazine of Canada, Convention Issue 1958, pp 172–176.

Referring to FIG. 4, such a vacuum is generated between the molded web 120B and the press roll 322, and between the molded web 120B and the press roll 362. The vacuum between the molded web 120B and the press roll 322 can also be supplemented by expansion of the dewatering felt 320 as the dewatering felt 320 exits the nip. If the dewatering felt 360 is omitted, the water pressed from the web into the deflection conduit portion 230 can be pulled back into the surface 124 of the molded web 120B by the vacuum generated adjacent the surface 122 of the molded web 120B. This vacuum is created in part by the nip roll 322 moving away from the web at the exit of the compression nip 300, and in part by the expansion of the dewatering felt 320 at the exit of the nip 300. In contrast, the inclusion of the dewatering felt 360 provides a relatively low capillary size flowpath for receiving water from the deflection conduit portion 230 of the imprinting member 219. Water flow from the deflection conduit portion 230 into the dewatering felt 360 is provided, at least in part, by the vacuum created by the separation of the dewatering felt 360 from the imprinting member 219 at the exit of the press nip 300. Accordingly, there is less water present in the deflection conduit portion 230 at the exit of the nip when the dewatering felt 360 is present. Also, expansion of the dewatering felt 360 at the exit of the nip adds to the total vacuum adjacent the surface 124 of the molded web 120B, and thereby helps to equalize the pressure across the molded web 120B at the exit of the nip.

In addition to preventing rewetting of the web molded in the compression nip 300, applicants have also found that it is desirable to minimize the shear forces acting on the web in the nip 300. The drying drum 510 can be driven at a predetermined speed about its axis of rotation by a suitable motor, thereby carrying the web and the imprinting member 219 through the nip at a predetermined speed. Shear forces on the web can be caused by a difference between the speed of the dewatering felt 320 and the speed of the web and imprinting member 219 in the nip 300. Such shear forces are undesirable because they can disrupt the fiber to fiber bonds and the molded web structure formed by pressing. Shearing of the web relative to the dewatering felt 320 can also generate a vacuum between the dewatering felt 320 and web in the nip 300, thereby causing rewetting of the web with water drawn from the deflection conduit portion 230.

Applicants have found that shearing of the web can be minimized by independently driving the press rolls 322 and 362 so as to carry the dewatering felts 320, 360, the web, and the imprinting member 219 through the nip 300 at substantially the same velocity in the machine direction, such as by independently driving the press rolls. By independently driving the press rolls it is meant that torque for rotation of each of the press rolls 322 and 362 is provided by a drive mechanism other than friction forces generated in the nip 300. Accordingly, neither of the press rolls 322 and 362 should be idler rolls. The press rolls 322 and 362 can be driven by the same motor, or by different motors. In one preferred embodiment one motor provides torque to rotate the dryer drum 510 and set the speed of the web and imprinting member 219 through the nip 300. Two different motors, one motor associated with each of the press rolls 322 and 362, provide torque to rotate the press rolls. Each motor provides the necessary torque to its respective press roll to overcome the friction loads and press nip work loads acting on the press roll. Individual torque control of the press roll motors can be accomplished by controlling the armature current of a DC motor, such as a shunt wound DC motor available from the Reliance Electric Company of Cleveland, Ohio. Alternatively, the necessary torque can be delivered to the press rolls by controlling the torque output of an AC adjustable speed motor. The necessary torque to be delivered to each press roll will depend upon a number of factors, including but not limited to the pressing pressure and the types of frictional loads acting on the press rolls. The necessary torque can be approximated by calculation. Alternatively, the necessary torque can be determined by trial and error by varying the torque to the press rolls and measuring the tensile strength of the molded paper web, or the water removed from the web in the compression nip. Other factors being held constant, the tensile strength of the molded paper web will generally be maximum when the shearing of the web has been minimized.

A sixth step in the practice of the present invention can comprise pre-drying the molded web 120B, such as with a through-air dryer 400 as shown in FIG. 1. The molded web 120B can be pre-dried by directing a drying gas, such as heated air, through the molded web 120B. In one embodiment, the heated air is directed first through the molded web 120B from the first web face 122 to the second web face 124, and subsequently through the deflection conduit portion 230 of the imprinting member 219 on which the molded web is carried. The air directed through the molded web 120B partially dries the molded web 120B. In addition, without being limited by theory, it is believed that air passing through the portion of the web associated with the deflection conduit portion 230 can further deflect the web into the deflection conduit portion 230, and reduce the density of the relatively low density region 1084, thereby increasing the bulk and apparent softness of the molded web 120B. In one embodiment the molded web 120B can have a consistency of between about 30 and about 65 percent upon entering the through air dryer 400, and a consistency of between about 40 and about 80 upon exiting the through air dryer 400.

Referring to FIG. 1, the through air dryer 400 can comprise a hollow rotating drum 410. The molded web 120B can be carried around the hollow drum 410 on the imprinting member 219, and heated air can be directed radially outward from the hollow drum 410 to pass through the web 120B and the imprinting member 219. Alternatively, the heated air can be directed radially inward (not shown). Suitable through air dryers for use in practicing the present invention are disclosed in U.S. Pat. No. 3,303,576 issued May 26, 1965 to Sisson and U.S. Pat. No. 5,274,930 issued Jan. 4, 1994 to Ensign et al., which patents are incorporated herein by reference. Alternatively, one or more through air dryers 400 or other suitable drying devices can be located upstream of the nip 300 to partially dry the web prior to pressing the web in the nip 300.

A seventh step in the practice of the present invention can comprise impressing the web imprinting surface 222 of the foraminous imprinting member 219 into the molded web 120B to form an imprinted web 120C. Impressing the web imprinting surface 222 into the molded web 120B serves to further densify the relatively high density region 1083 of the molded web, thereby increasing the difference in density between the regions 1083 and 1084. Referring to FIG. 1, the molded web 120B is carried on the imprinting member 219 and interposed between the imprinting member 219 and an impression surface at a nip 490. The impression surface can comprise a surface 512 of a heated drying drum 510, and the nip 490 can be formed between a roll 209 and the dryer drum 510. The imprinted web 120C can then be adhered to the surface 512 of the dryer drum 510 with the aid of a creping adhesive, and finally dried. The dried, imprinted web 120C can be foreshortened as it is removed from the dryer drum 510, such as by creping the imprinted web 120C from the dryer drum with a doctor blade 524.

The method provided by the present invention is particularly useful for making paper webs having a basis weight of between about 10 grams per square meter to about 65 grams per square meter. Such paper webs are suitable for use in the manufacture of single and multiple ply tissue and paper towel products.

Figure 13B:
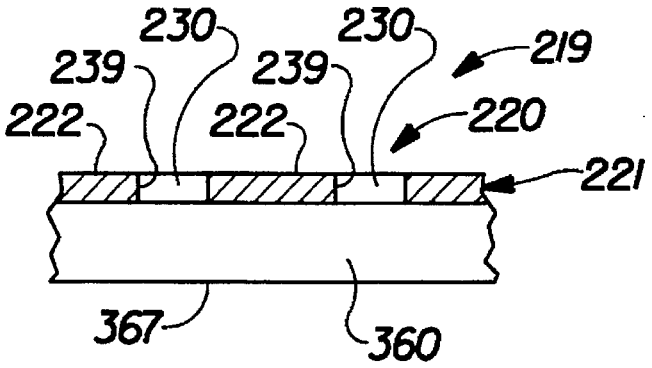
FIG. 13B is a enlarged partial cross-sectional view of the composite imprinting member having a photopolymer web patterning layer joined to the surface of a felt layer.
Figure 12:
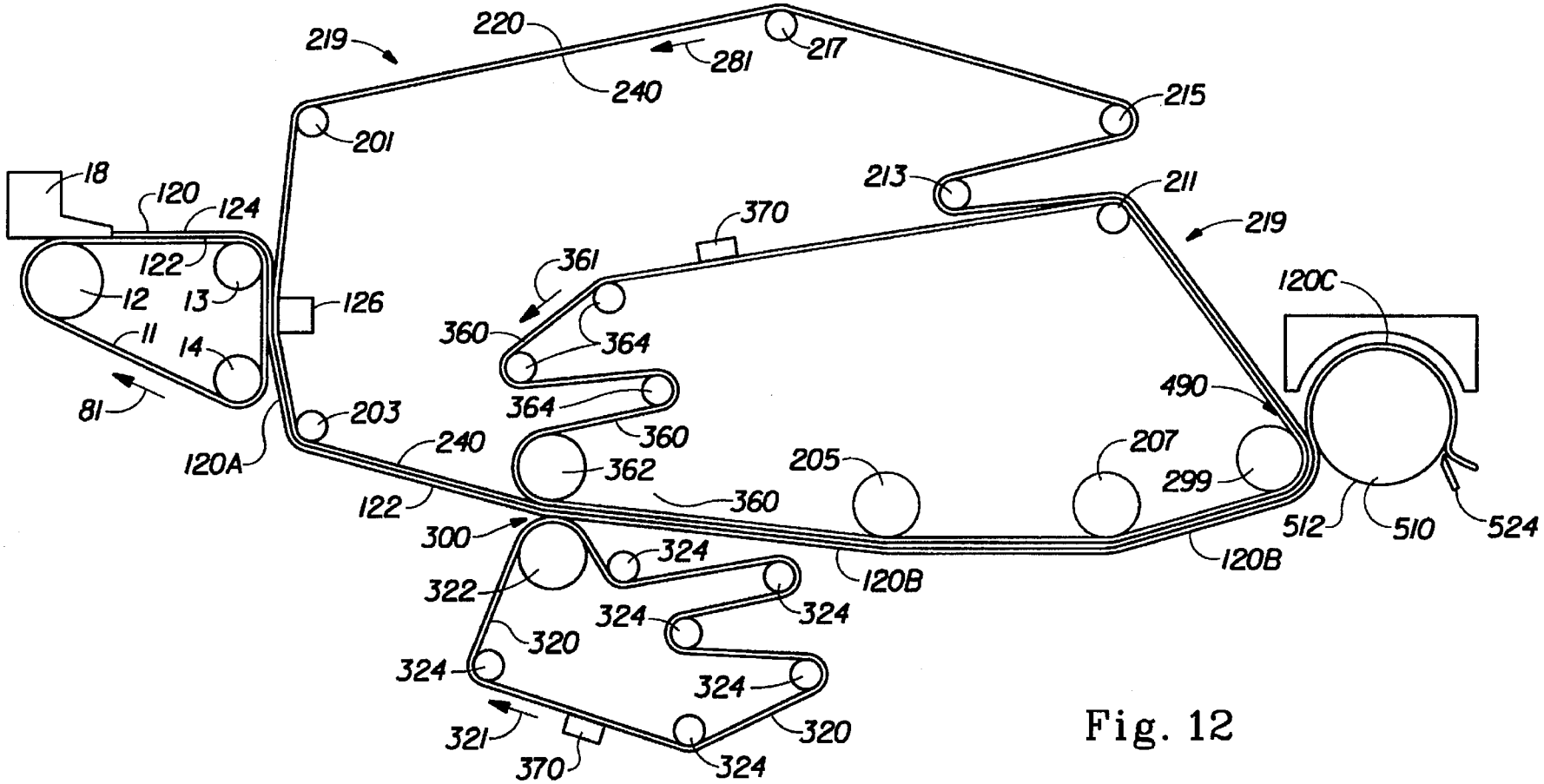
FIG. 12 is an alternative embodiment of a paper machine according to the present invention wherein a dewatering felt is positioned adjacent the imprinting member as the web is carried on the imprinting member from a press nip to a Yankee dryer drum.
Figure 13A:
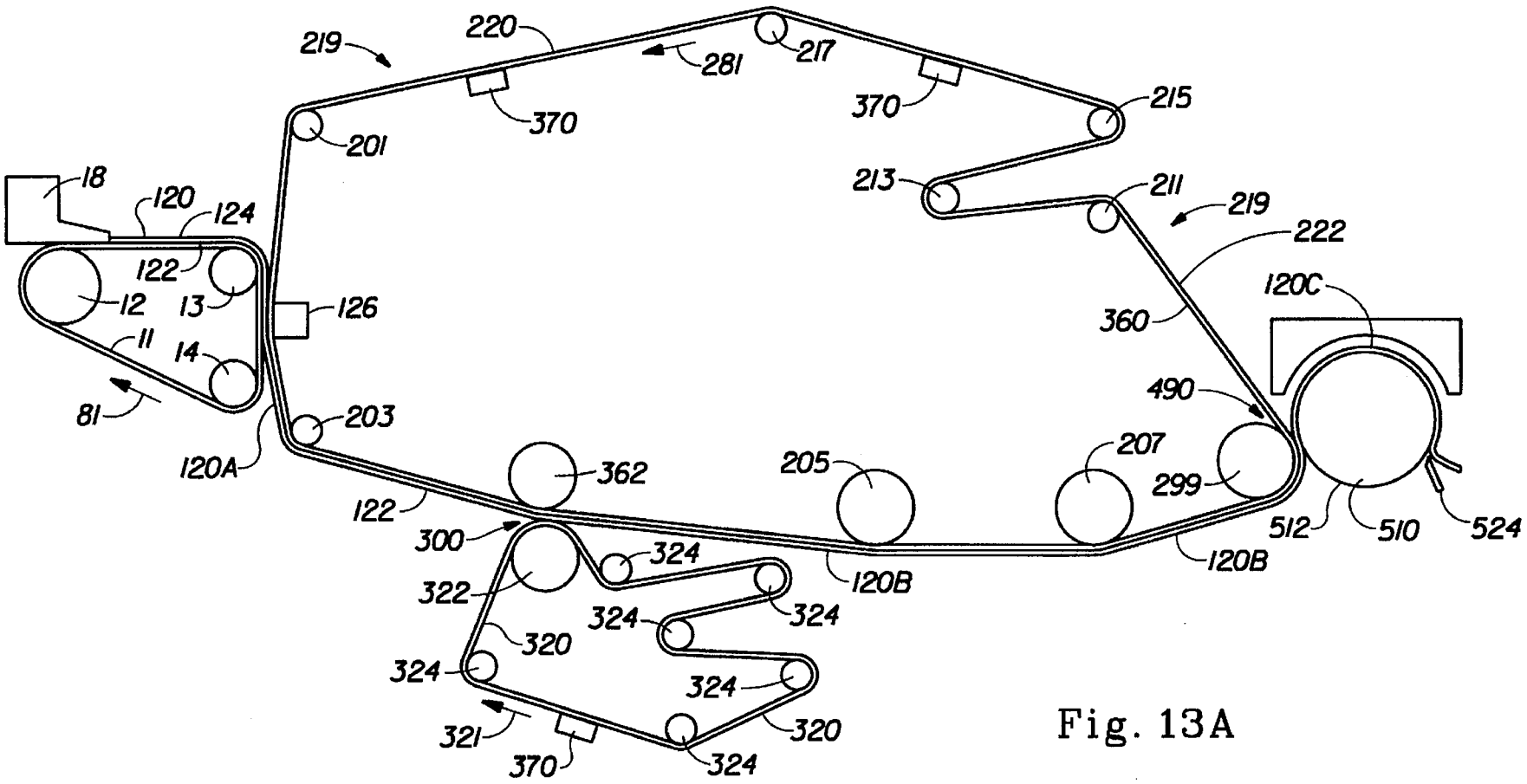
FIG. 13A is an alternative embodiment of a paper machine according to the present invention having a composite imprinting member comprising a foraminous web patterning layer formed from a photopolymer joined to the surface of a dewatering felt layer.

FIGS. 12 and 13A show alternative paper machine embodiments of the present invention wherein the through air-dryer 400 is omitted. In FIG. 12, the second felt 360 is positioned adjacent the second face 240 of the imprinting member 219 as the molded web 120B is carried on the imprinting member 219 from the nip 300 to the nip 490. The nip 490 in FIG. 12 is formed between a pressure roll 299 and the Yankee drum 510. The pressure roll 299 can be a vacuum pressure roll which removes water from the second felt 360 at the nip 490. Alternatively, the pressure roll 299 can be a solid roll. With the second felt 360 positioned adjacent the second face 240 of the imprinting member 219, the molded web 120B is carried on the imprinting member 219 to the nip 490 to provide transfer of the molded web 120B to the Yankee drum 510.

Figure 15:
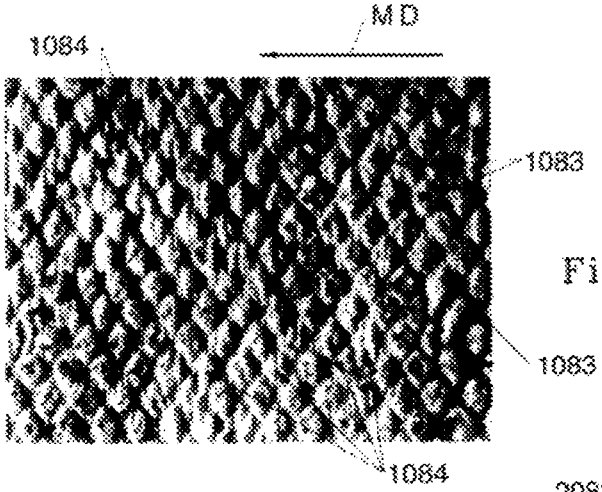
FIG. 15 is photograph of a paper web made using the paper machine of FIG. 12 showing relatively low density domes which are foreshortened by creping, the domes dispersed throughout a relatively high density, continuous network region.
Figure 16:
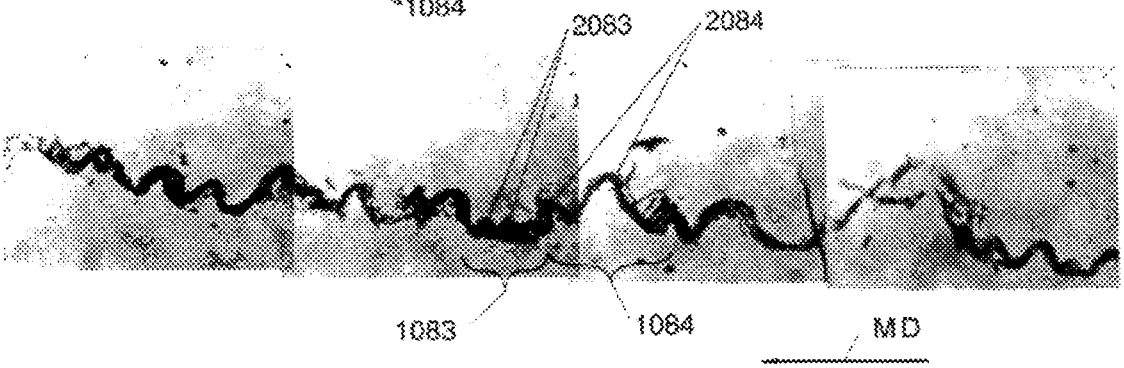
FIG. 16 is a photomicrograph of a cross-section of a portion of a creped paper web corresponding to the web shown in FIG. 15 and made using the paper machine of FIG. 12, the figure showing foreshortened relatively low density domes and a foreshortened relatively high density continuous network region.

FIGS. 15 and 16 show a paper web made using the paper machine embodiment of FIG. 12. FIG. 15 is a plan view of the web face 124, which is the face of the web which is positioned adjacent the imprinting member 219 in the nip 300. The web in FIG. 15 is made using an imprinting member 219 having a continuous network web imprinting surface 222 and a plurality of discrete deflection conduits 230. The web in FIG. 15 has a plurality of relatively low density domes 1084 dispersed throughout a relatively high density continuous network region 1083. At least some of the domes 1084 in FIG. 15 are foreshortened by creping, as evidenced by creasing or buckling of some of the domes in FIG. 15. Foreshortening of the domes 1084 is more clearly shown in FIG. 16, which also illustrates foreshortening of the continuous network region 1083. The cross-section view of FIG. 16 is taken parallel to the machine direction to illustrate the foreshortening due to creping. In FIG. 16, foreshortening of a dome 1084 is characterized by crepe ridges 2084, and foreshortening of the continuous network region 1083 is characterized by crepe ridges 2083. The domes 1084 can have a crepe frequency (number of ridges 2084 per unit length measured in the machine direction) which is different from the creping frequency of the continuous network 1083 (number of ridges 2083 per unit length measured in the machine direction).

Referring to FIGS. 13A and 13B, the paper machine has a composite imprinting member 219 having a web patterning photopolymer layer 221 joined to the surface of a dewatering felt 360. The photopolymer layer 221 has a macroscopically monoplanar, patterned continuous network web imprinting surface 222. Such a composite imprinting member 219 can comprise a photopolymer resin cast onto the surface of a dewatering felt. U.S. patent application Ser. No. 08/268,154, "Web Patterning Apparatus Comprising a Felt Layer and a Photosensitive Resin Layer," filed Jun. 28, 1994 in the name of Trokhan, et al. is incorporated herein by reference for the purpose of showing the construction of such a composite imprinting member. The deflection conduits 230 of the photopolymer layer 221 are in flow communication with the felt layer 360, as shown in FIG. 13B.

In FIG. 13A, the embryonic web 120 is transferred to the photopolymer web imprinting surface 222 of the composite imprinting member 219. The web is pressed in the nip 300 between the first felt 320 and the composite imprinting member 219, which comprises the photopolymer web imprinting surface 222 and the second felt 360. The molded web 120B is then carried on the web imprinting surface 222 of the composite web imprinting member to the nip 490. The nip 490 in FIG. 13A is formed between a pressure roll 299 and the Yankee drum 510. The pressure roll 299 can be a vacuum pressure roll which removes water from the second felt 360 at the nip 490, or alternatively, the pressure roll 299 can be a solid roll. With the composite imprinting member 219 positioned adjacent the face 124 of the molded web 120B, the web is carried on the composite imprinting member 219 into the nip 490 to transfer the molded web 120B to the Yankee drum 510.

Figure 17:
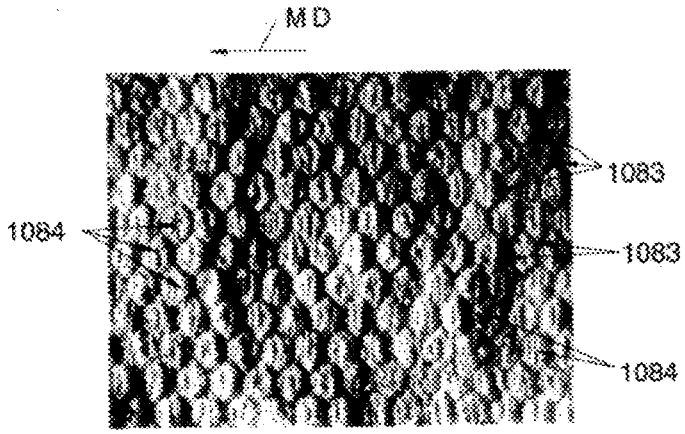
FIG. 17 is photograph of a paper web made using the paper machine of FIG. 13A showing relatively low density domes which are foreshortened by creping, the domes dispersed throughout a relatively high density, continuous network region.
Figure 18:
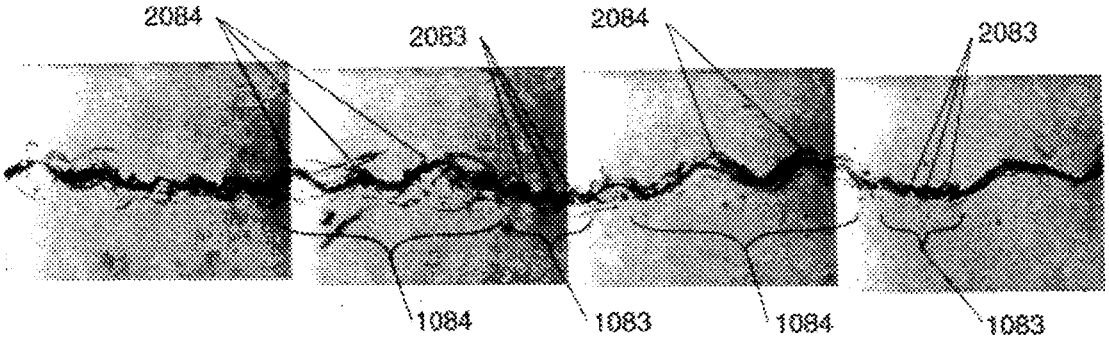
FIG. 18 is a photomicrograph of a cross-section of a portion of a creped paper web corresponding to the web shown in FIG. 17 and made using the paper machine of FIG. 13, the figure showing foreshortened relatively low density domes and a foreshortened relatively high density continuous network region.

FIGS. 17 and 18 show a paper web made using the paper machine embodiment of FIG. 13A. FIG. 17 is a plan view of the web face 124, which is the face of the web which is positioned adjacent the imprinting member 219 in the nip 300. The web in FIG. 17 is made using an imprinting member 219 having a continuous network web imprinting surface 222 and a plurality of discrete deflection conduits 230. The web in FIG. 17 has a plurality of relatively low density domes 1084 dispersed throughout a relatively high density continuous network region 1083. At least some of the domes 1084 in FIG. 17 are foreshortened by creping, as evidenced by creasing or buckling of some of the domes in FIG. 17. Foreshortening of the domes 1084 is more clearly shown in FIG. 18, which also illustrates foreshortening of the continuous network region 1083. The cross-section view of FIG. 18 is taken parallel to the machine direction to illustrate the foreshortening due to creping. In FIG. 18, foreshortening of a dome 1084 is characterized by crepe ridges 2084, and foreshortening of the continuous network region 1083 is characterized by crepe ridges 2083. The domes 1084 can have a crepe frequency (number of ridges 2084 per unit length measured in the machine direction) which is different from the creping frequency of the continuous network 1083 (number of ridges 2083 per unit length measured in the machine direction).

A paper web according to the present invention has a measured thickness ratio P/K which is greater than 1.0, and a measured thickness ratio T/K which is less than 0.90. In one embodiment, the thickness ratio T/K is less than about 0.80, more preferably less than about 0.70, and most preferably less than about 0.65; and the thickness ratio P/K is preferably at least about 1.5 more preferably at least about 1.7, and most preferably at least about 2.0.

ANALYTICAL PROCEDURES

Measurement of Thickness

Figure 14:
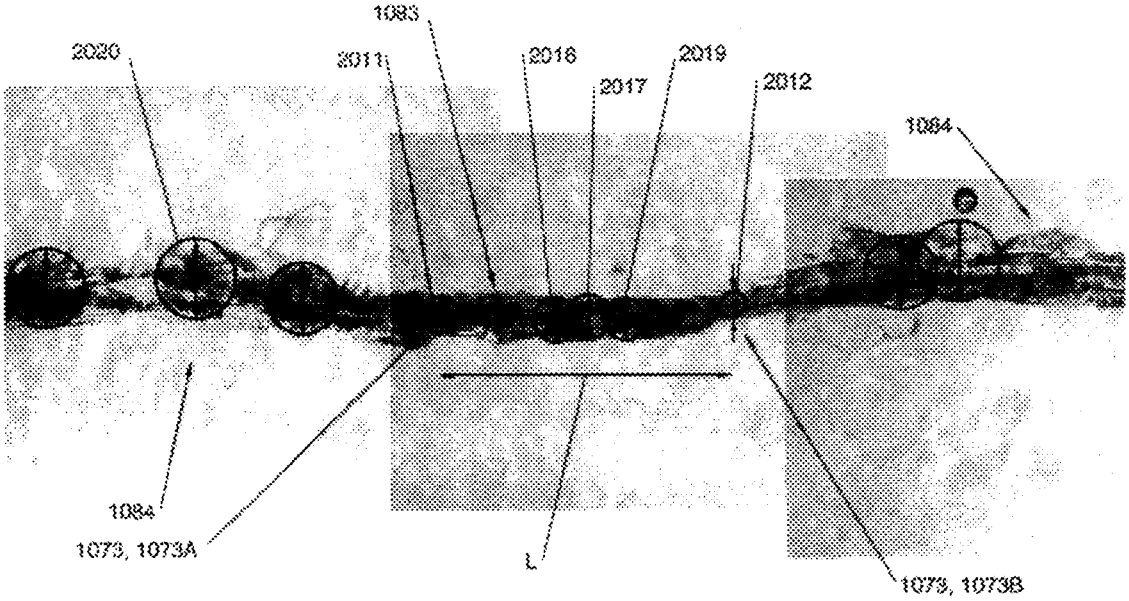
FIG. 14 is a photomicrograph of a cross-section of a portion of a paper web illustrating thickness measurements.

The thickness and elevations of various sections of a sample of the fibrous structure are measured from photomicrographs of microtome cross-sections of the paper structure. A photomicrograph of such a microtome cross-section is shown in FIG. 14. The microtome cross-section is made from a sample of paper measuring about 2.54 centimeters by 5.1 centimeters (1 inch by 2 inches). The sample is marked with reference points to determine where microtome slices are made. The sample is stapled onto the center of two rigid cardboard frames. The frames are cut from file folder card stock. Each cardboard frame measures about 2.54 centimeters by 5.1 centimeters. The frame width is about 0.25 centimeters. The cardboard frame holder containing the sample is placed in a silicone mold having a well measuring about 2.54 centimeters by 5.1 centimeters by 0.5 centimeter deep. A resin such as Merigraph photopolymer manufactured by Hercules, Inc. is poured into the silicone mold containing the sample. The paper sample is completely immersed in the resin. The sample is cured to using an ultraviolet light to harden the resin mixture. The hardened resin containing the sample is removed. The frame is cut away from the resin block and the sample is trimmed for sectioning using a utility knife.

The sample is placed in a model 860 microtome sold by the American Optical Company of Buffalo, N.Y. and leveled. The edge of the sample is removed from the sample, in slices, by the microtome until a smooth surface appears.

A sufficient number of slices are removed from the sample, so that the various regions may be accurately reconstructed. For the embodiment described herein, slices having a thickness of about 100 microns per slice are taken from the smooth surface. Multiple slices may be required so that the thickness of the various regions may be ascertained. For thickness measurements of creped samples, the slices are obtained in the cross machine direction so as not to have interferences due to crepe ridges (the cross-sections in FIGS. 16 and 18 are taken in the machine direction for purposes of showing crepe ridges).

A sample slice is mounted on a microscope slide using oil and a cover slip. The slide and the sample are mounted in a light transmission microscope such as a Nikon Model 63004 available from Nikon Instruments, Melville, N.Y. fitted with a high resolution video camera. The sample is observed with a 10X objective. Videomicrographs are taken along the slice using the high resolution video camera (such as Javelin Model JE3662HR, manufactured by Javelin Electronics, Los Angeles Calif.) a frame grabber board such as a Data Translations Frame Grabber Board, manufactured by Data Translation, Marlboro, Mass., imaging software such as NIH Image Version 1.41 available from NTIS, of Springfield, Va., and a data system, such as a Macintosh Quadra 840AV. Videomicrographs are taken along the slice, and the individual Videomicrographs are arranged in a series to reconstruct the profile of the slice. The magnification of the videomicrographs on a 6.75 inch by 9 inch hardcopy can be about 400X.

The thickness of the areas of interest may be established by using a suitable CAD computer drafting software such as Power Draw version 4.0 available from Engineered Software of North Carolina. The Videomicrographs obtained in Image 1.4 are selected, copied, and then pasted in Power Draw. Individual photomicrographs are arranged in series to reconstruct the profile of the slice. The appropriate calibration of the system is performed by obtaining a Videomicrograph of a calibrated rule such as 1/100 mm Objective Stage Micrometer N36121, available from Edmund Scientific, Barrington, N.J., copying, and then pasting in the CAD software.

The thickness at any particular point in a region of interest can be determined by drawing the largest circle that can be fit inside the region at that particular point without exceeding the boundaries of the image, as shown in FIG. 14. The thickness of the region at that point is the diameter of the circle. In FIG. 14, the relatively high density region 1083 comprises a continuous network region, and the relatively low density region 1084 comprises relatively low density domes.

Thickness Ratios

Referring to FIG. 14, the thicknesses T of the transition region 1073, K of the relatively high density region 1083, and P of the relatively low density region 1084 are measured according to the following procedure. First, a cross-section is located having a portion of a relatively high density region 1083 extending intermediate relatively low density regions 1084, and a transition region 1073 located adjacent each end of the portion of the relatively high density region 1083. The transition region 1073 adjacent each end of the portion of the relatively high density region 1083 is a minimum thickness, neck down point intermediate the relatively high density region 1083 and the relatively low density region 1084. In FIG. 14, the transition regions adjacent each end of a portion of a relatively high density region 1083 are labeled 1073A and 1073B.

Up to twenty microtomed cross sections are scanned to locate a total of five cross-sections having a portion of a relatively high density region 1083 and a transition region 1073 adjacent each end of the portion the relatively high density region 1083, wherein: 1) the thickness everywhere in that portion of the region 1083 is greater than the thickness of the region 1073 at each end of the region 1083; and 2) the thickness everywhere in that portion of the region 1083 is less than the maximum thickness of the low density regions 1084 between which that portion of the region 1083 extends. If less than five such cross-sections are located after scanning twenty microtomed cross-sections, then the sample is said not to contain a transition region 1073.

The thicknesses of the transition regions 1073A, 1073B at each end of the region 1083 are measured as the diameters of the largest circles 2011 and 2012 which can be fit in the transition regions 1073A and 1073B. The thickness T is the average of these two measurements. In FIG. 14, the diameters of the circles 2011 and 2012 are 0.043 mm and 0.030 mm, respectively, so the value of T for the cross-section in FIG. 14 is 0.036 min. The thickness K of the relatively high density region 1083 extending between the regions 1073A and 1073B is next determined. The distance L between the two circles 2011 and 2012 is measured (about 0.336 mm in FIG. 14). A circle 2017 is drawn centered one half of the distance L between the centers of circles 2011 and 2012. Circles 2018 and 2019 are drawn having centers positioned a distance equal to L/8 to the fight and to the left of the center of the circle 2017. The thickness K of the region 1083 is the average of the diameters of the three circles 2017—2019. In FIG. 14, these circles have diameters of 0.050 ram, 0.050 ram, and 0.048 mm respectively, so the thickness K is about 0.049 mm. The thickness P is defined as the maximum of the local maximum thickness to the left of region 1073A and the local maximum thickness to the fight of region 1073B in the relatively low density regions 1084. For the cross-section shown in FIG. 14 the thickness P is equal to the diameter of the circle 2020, or about 0.091 ram. The ratio T/K for the cross-section shown in FIG. 14 is 0.036/0.049=0.74. The ratio P/K for the cross-section shown in FIG. 14 is 0.091/0.049=1.8. The reported thickness ratio T/K is the average of the ratio T/K for five cross-sections. The reported thickness ratio P/K is the average of the ratio P/K for the same five cross-sections.

TOTAL TENSILE STRENGTH

Total tensile strength (TT) as used herein means the sum of the machine and cross-machine maximum strength (in grams/meter) divided by the basis weight of the sample (in grams/square meter). The value of TT is reported in meters. The maximum strength is measured using a tensile test machine, such as an Intelect II STD, available from Thwing-Albert, Philadelphia, Pa. The maximum strength is measured at a cross head speed of 1 inch per minute for creped samples, and 0.1 inch per minute for uncreped handsheet samples. For handsheets, only the machine direction maximum strength is measured, and the value of TT is equal to twice this machine direction maximum strength divided by the basis weight. The value of IT is reported as an average of at least five measurements.

WEB STIFFNESS

Web stiffness as used herein is defined as the slope of the tangent of the graph of force On grams/centimeter of sample width) versus strain (cm elongation per cm of gage length). Web flexibility increases, and web stiffness decreases, as the slope of the tangent decreases. For creped samples the tangent slope is obtained at 15 g/cm force, and for non-creped samples the tangent slope is obtained at 40 g/cm force. Such data may be obtained using an Intelect II STD tensile test machine, available from Thwing-Albert, Philadelphia, Pa., with a cross head speed of 1 inch per minute and a sample width of about 4 inches for creped samples, and 0.1 inch per minute and a sample width of about 1 inch for non-creped handsheets. The Total Stiffness index (TS) as used herein means the geometric mean of the machine-direction tangent slope and the cross-machine-direction tangent slope. Mathematically, this is the square root of the product of the machine-direction tangent slope and cross-machine-direction tangent slope in grams per centimeter. For handsheets, only the machine direction tangent slope is measured, and the value of TS is taken to be the machine direction tangent slope. The value of TS is reported as an average of at least five measurements. In Tables 1 and 2 TS is normalized by Total Tensile to provide a normalized stiffness index TS/TT.

CALIPER

Macro-caliper as used herein means the macroscopic thickness of the sample. The sample is placed on a horizontal flat surface and confined between the flat surface and a load foot having a horizontal loading surface, where the load foot loading surface has a circular surface area of about 3.14 square inches and applies a confining pressure of about 15 g/square cm (0.21 psi) to the sample. The macro-caliper is the resulting gap between the flat surface and the load foot loading surface. Such measurements can be obtained on a VIR Electronic Thickness Tester Model II available from Thwing-Albert, Philadelphia, Pa. The macro-caliper is an average of at least five measurements.

BASIS WEIGHT

Basis weight as used herein is the weight per unit area of a tissue sample reported in grams per square meter.

APPARENT DENSITY

Apparent density as used herein means the basis weight of the sample divided by the Macro-caliper.

EXAMPLES

Example 1

The purpose of this example is to illustrate a method using a through air drying papermaking to make soft and absorbent paper towel sheets treated with a chemical softener composition comprising a mixture of Di(hydrogenated) Tallow Dimethyl Ammonium Chloride (DTDMAC), a Polyethylene glycol 400 (PEG-400), a permanent wet strength resin and then pressed according the processed described herein.

A pilot scale Fourdrinier papermaking machine is used in the practice of the present invention as shown in FIG. 1. First, a 1% solution of the chemical softener is prepared according to the procedure in Example 3 of U.S. Pat. No. 5,279,767 issued Jan. 18, 1994 to Phan et al. Second, a 3% by weight aqueous slurry of NSK is made up in a conventional re-pulper. The NSK slurry is refined gently and a 2% solution of a permanent wet strength resin (i.e. Kymene 557H marketed by Hercules incorporated of Wilmington, Del.) is added to the NSK stock pipe at a rate of 1% by weight of the dry fibers. The adsorption of Kymene 557H to NSK is enhanced by an in-line mixer. A 1% solution of Carboxy Methyl Cellulose (CMC) is added after the in-line mixer at a rate of 0.2% by weight of the dry fibers to enhance the dry strength of the fibrous substrate. The adsorption of CMC to NSK can be enhanced by an in-line mixer. Then, a 1% solution of the chemical softener mixture (DTDMAC/PEG) is added to the NSK slurry at a rate of 0.1% by weight of the dry fibers. The adsorption of the chemical softener mixture to NSK can also enhanced via an in-line mixer. The NSK slurry is diluted to 0.2% by the fan pump. Third, a 3% by weight aqueous slurry of CTMP is made up in a conventional re-pulper. A non-ionic surfactant (Pegosperse) is added to the re-pulper at a rate of 0.2% by weight of dry fibers. A 1% solution of the chemical softener mixture is added to the CTMP stock pipe before the stock pump at a rate of 0.1% by weight of the dry fibers. The adsorption of the chemical softener mixture to CTMP can be enhanced by an in-line mixer. The CTMP slurry is diluted to 0.2% by the fan pump. The treated furnish mixture (NSK/CTMP) is blended in the head box and deposited onto a Fourdrinier wire 11 to form an embryonic web 120. Dewatering occurs through the Fourdrinier wire and is assisted by a deflector and vacuum boxes. The Fourdrinier wire is of a 5-shed, satin weave configuration having 84 machine-direction and 76 cross-machine-direction monofilaments per inch, respectively. The embryonic wet web is transferred from the Fourdrinier wire, at a fiber consistency of about 22% at the point of transfer, to an imprinting member 219. The imprinting member 219 has about 240 bilaterally staggered, oval shaped deflection conduits 230 per square inch of the web contacting face 220. The major axis of the oval shaped deflection conduits is generally parallel to the machine direction. The deflection conduits 230 have a depth 232 of about 14 mils. The imprinting member 219 has a continuous network photopolymer web imprinting surface 222. The surface area of the continuous network web imprinting surface 222 is about 34 percent of the surface area of the web contacting face 220 (34 percent knuckle area).

Further de-watering is accomplished by vacuum assisted drainage until the web has a fiber consistency of about 28%. The non-monoplanar, patterned web 120A is pressed between two felts at a pressure of approximately 250 PSI in the nip 300. The resulting molded web 120B has a fiber consistency of about 34%. The web is then pre-dried by the through air dryer 400 to a fiber consistency of about 65% by weight. The web is then adhered to the surface of the Yankee dryer drum 510 with a sprayed creping adhesive comprising 0.25% aqueous solution of Polyvinyl Alcohol (PVA). The fiber consistency is increased to an estimated 96% before the dry creping the web with a doctor blade. The doctor blade has a bevel angle of about 25 degrees and is positioned with respect to the Yankee dryer to provide an impact angle of about 81 degrees; the Yankee dryer is operated at about 800 fpm (feet per minute) (about 244 meters per minute). The dry web is formed into a roll at a speed of 700 fpm (214 meters per minutes).

The properties of a pressed paper web made according to Example 1 (press pressure 250 psi) are listed in Table 1. The corresponding properties of an unpressed base paper web made with the same furnish, web transfer, and web imprinting member 219 are also listed for comparison in Table 1. In particular, the normalized stiffness index of the pressed web is less than that of the unpressed base web, while the total tensile strength of the pressed web exceeds that of the unpressed base web.

Two or more of the pressed webs can be combined to form a multi-ply product. For instance, two pressed webs made according to Example 1 can be combined to form a two ply paper towel by embossing and laminating the webs together using PVA adhesive. The resulting paper towel contains about 0.2% by weight of the chemical softener mixture and about 1.0% by weight of the permanent wet strength resin. The resulting paper towel is soft, and is as absorbent as, and stronger than a two ply paper towel made from two unpressed base webs.

Example 2

The purpose of this example is to illustrate a method using a through air drying papermaking technique to make soft and absorbent paper webs for use in making paper towels. The webs are treated with a chemical softener composition comprising a mixture of Di(hydrogenated) Tallow Dimethyl Ammonium Chloride (DTDMAC), a Polyethylene glycol 400 (PEG-400), a permanent wet strength resin and then pressed at a higher pressure than in Example 1. The through air paper machine is shown in FIG. 1.

The web is formed as described in Example 1 except the pressing pressure in the press is 300 PSI. The properties of the pressed paper web made according to Example 2 are listed in Table 1. Two or more of the pressed webs can be combined to form a multi-ply product by embossing and laminating the webs together using PVA adhesive. A two ply paper towel made by combining two of the pressed webs made according to Example 2 is soft, and is as absorbent as, and stronger than the two ply paper towel made by combining two pressed webs made according to Example 1.

TABLE 1

Properties of creped paper towel webs.

| Property | Base web unpressed | Pressed web 250 PSI (Example 1) | Pressed web 300 PSI (Example 2) |
|---|---|---|---|
| TT (m) | 1532 | 2165 | 2200 |
| TS/TT | 6.41 | 4.81 | 5.07 |
| Basis Wt g/m̂ 2 | 22.0 | 21.8 | 21.9 |
| Apparent Density kg/cubic meter | 51.0 | 49.3 | 50.2 |
| Transition Thickness (mm) | 0.061 | 0.037 | 0.032 |
| Knuckle Thickness (mm) | 0.067 | 0.056 | 0.052 |
| Pillow Thickness (mm) | 0.131 | 0.117 | 0.143 |
| T/K | 0.91 | 0.67 | 0.63 |
| P/K | 1.91 | 2.26 | 2.78 |
| Macro caliper mm | 0.43 | 0.44 | 0.44 |

Example 3

This example describes the production of a tissue product made without the use of a through air dryer. A pilot scale Fourdrinier papermaking machine is used in the practice of the present invention. The paper machine is shown in FIG. 12. Briefly, a first fibrous slurry comprised primarily of short papermaking fibers is mixed with a second fibrous slurry comprised primarily of long papermaking fibers and is pumped through the headbox chamber and delivered onto the Fourdrinier wire to form thereon an embryonic web. The first slurry has a fiber consistency of about 0.11% and its fibrous content is Eucalyptus Hardwood Kraft. The second slurry has a fiber consistency of about 0.1 1% and its fibrous content is Northern Softwood Kraft. The ratio of Eucalyptus to Northern Softwood is approximately 60/40. Dewatering occurs through the Fourdrinier wire and is assisted by a deflector and vacuum boxes. The Fourdrinier wire is of a 5-shed, satin weave configuration having 87 machine-direction and 76 cross-machine-direction monofilaments per inch, respectively.

The embryonic wet web is transferred from the Fourdrinier wire, at a fiber consistency of about 22% at the point of transfer, to a web imprinting member 219. The imprinting member 219 has about 240 bilaterally staggered, oval shaped deflection conduits 230 per square inch of the web contacting face 220. The major axis of the oval shaped deflection conduits is generally parallel to the machine direction. The deflection conduits 230 have a depth 232 of about 14 mils. The imprinting member 219 has a continuous network photopolymer web imprinting surface 222. The surface area of the continuous network web imprinting surface 222 is about 34 percent of the surface area of the web contacting face 220 (34 percent knuckle area).

Further de-watering is accomplished by vacuum assisted drainage until the web has a fiber consistency of about 28%. The non-monoplanar, patterned web 120A is pressed between the first and second dewatering felts 320 and 360 two felts at a pressure of approximately 250 PSI. The resulting molded web 120B has a fiber consistency of about 34%. With the second felt 360 positioned adjacent the second face 240 of the imprinting member 219, the molded web 120B is carried on the imprinting member 219 to the nip 490 to provide transfer of the molded web 120B to the Yankee drum 510.

The web is then adhered to the surface of a Yankee dryer with a sprayed creping adhesive comprising 0.25% aqueous solution of Polyvinyl Alcohol (PVA). The fiber consistency is increased to an estimated 96% before the dry creping the web with a doctor blade. The doctor blade has a bevel angle of about 25 degrees and is positioned with respect to the Yankee dryer to provide an impact angle of about 81 degrees; the Yankee dryer is operated at about 800 fpm (feet per minute) (about 244 meters per minute). The dry web is formed into roll at a speed of 700 fpm (214 meters per minutes).

The pressed creped tissue product has a basis weight of 16 g/sq meter and a tensile strength greater than an unpressed base tissue web made with the same furnish and imprinting member 219. The relatively low density domes 1084 of the resulting creped paper web are foreshortened and have a creping frequency which can be different than that of the continuous network, relatively high density region 1083. A plan view photograph of the resulting structure is shown in FIG. 15, and a photomicrograph cross sectional picture of the structure is shown in FIG. 16.

Example 4

This example describes the production of a two layered tissue product made without the use of a through air dryer. A pilot scale Fourdrinier papermaking machine is used in the practice of the present invention. The paper machine, which is shown in FIG. 13A, has a layered headbox having a top chamber, and a bottom chamber. Briefly, a first fibrous slurry comprised primarily of short papermaking fibers is pumped through the bottom headbox chamber and, simultaneously, a second fibrous slurry comprised primarily of long papermaking fibers is pumped through the top headbox chamber and delivered in superposed relation onto the Fourdrinier wire to form thereon a two-layer embryonic web. The first slurry has a fiber consistency of about 0.11% and its fibrous content is Eucalyptus Hardwood Kraft. The second slurry has a fiber consistency of about 0.15% and its fibrous content is Northern Softwood Kraft. Dewatering occurs through the Fourdrinier wire and is assisted by a deflector and vacuum boxes. The Fourdrinier wire is of a 5-shed, satin weave configuration having 87 machine-direction and 76 cross-machine-direction monofilaments per inch, respectively.

The embryonic wet web is transferred from the Fourdrinier wire, at a fiber consistency of about 10% at the point of transfer, to a composite imprinting member 219 having a photopolymer layer joined to the surface of a dewatering felt 360. The photopolymer layer has a macroscopically monoplanar, patterned continuous network web imprinting surface 222. Transfer of the web from the Fourdrinier wire to the composite imprinting member 219 is assisted by using a vacuum pick-up shoe 126. The continuous network web imprinting surface 222 of the photopolymer layer has a plurality of discrete, isolated, non-connecting deflection conduits. The pattern of the deflection conduits is identical to the pattern in Example 1, and the photopolymer layer extends about 14 mils from the surface of the felt 360.

Following vacuum transfer the web is non-monoplanar and has a pattern corresponding to the web imprinting surface 222. The web has a fiber consistency of about 24%. The non-monoplanar, patterned web is carried on the composite web imprinting member 219 to the nip 300, and is pressed between the first felt 320 and the composite imprinting member 219, which comprises the second felt 360. The web is pressed at a nip pressure of approximately 250 PSI.

The resulting molded web 120B has a fiber consistency of about 34%. The molded web 120B is then adhered to the surface of a Yankee dryer with a sprayed creping adhesive comprising 0.25% aqueous solution of Polyvinyl Alcohol (PVA). The fiber consistency is increased to an estimated 96% before dry creping the web with a doctor blade. The doctor blade has a bevel angle of about 25 degrees and is positioned with respect to the Yankee dryer to provide an impact angle of about 81 degrees; the Yankee dryer is operated at about 800 fpm (feet per minute) (about 244 meters per minute). The dry web is formed into roll at a speed of 700 fpm (214 meters per minutes).

The pressed creped tissue product has a basis weight of about 16 gram/square meter and a tensile strength greater than unpressed base tissue web made with the same furnish and imprinting member, but which is not pressed between two felt layers. The relatively low density domes 1084 of the resulting creped paper web are foreshortened and have a creping frequency which can be different than that of the continuous network, relatively high density region 1083. A plan view photograph of the resulting structure is shown in FIG. 17, and a photomicrograph cross sectional picture of the structure is shown in FIG. 18.

Example 5

This example describes the production of a noncreped paper product made without the use of a through air dryer. Briefly 30 grams of Northern Softwood pulp are defibered in 2000 ml water. The defibered pulp slurry is then diluted to 0.1% consistency on a dry fiber basis in a 20,000 ml proportioner. A volume of about 2543 ml of the diluted pulp slurry is added to a deckle box containing 20 liters of water. The bottom of the deckel box contains a 13.0 inch by 13.0 inch Polyester Monofilament plastic Fourdrinier wire supplied by Appleton Wire Co. Appleton, Wis. The wire is of a 5-shed, satin weave configuration having 84 machine-direction and 76 cross-machine-direction monofilaments per inch, respectively. The fiber slurry is uniformly distributed by moving a perforated metal deckle box plunger from near the top of the slurry to the bottom of the slurry back and forth for three complete "up and down" cycles. The "up and down" cycle time is approximately 2 seconds. The plunger is then withdrawn slowly. The slurry is then filtered through the wire. After the water slurry is drained through the wire the deckle box is opened and the wire and the fiber mat are removed. The wire containing the wet web is next pulled across a vacuum slot to dewater the web. The peak vacuum is approximately 4 in Hg. The embryonic wet web is transferred from the wire, at a fiber consistency of about 15% at the point of transfer, to an imprinting member having width and length dimension about equal to the width and length of the wire.

The imprinting member has a continuous network photopolymer web imprinting surface 222. The imprinting member has about 300 bilaterally staggered, oval shaped deflection conduits 230 per square inch of the web contacting face 220. The major axis of the oval shaped deflection conduits is generally parallel to the machine direction. The deflection conduits 230 have a depth 232 of about 14 mils. The surface area of the continuous network web imprinting surface 222 is about 34 percent of the surface area of the web contacting face 220 (34 percent knuckle area).

The transfer is accomplished by forming a "sandwich" of the imprinting member, the web, and the wire. The "sandwich" is pulled across a vacuum slot to complete the transfer. The peak vacuum is about 10 in. Hg. The wire is then removed from the "sandwich", leaving a non-monoplanar, patterned web supported on the imprinting member. The web has a fiber consistency of about 20%. The web and the imprinting member are then pressed between two felt layers at a pressure of approximately 250 PSI. The resulting molded web has a fiber consistency of about 40%. The pressed web is dried by contact on a steam drum dryer.

The basis weight of the resulting dry web is 26.4 g/sq. meter. The tensile strength of the pressed sheet is greater than a base sheet made with the same furnish, wire, imprinting member, and transfer conditions, but without pressing the base sheet between two felt layers. Comparative data for this example is shown in Table 2.

TABLE 2

Properties of uncreped paper web handsheets.

| Property | Base | Pressed 250 PSI (Example 5) |
|---|---|---|
| TT (m) | 2414 | 3774 |
| TS/TT | 50 | 33 |
| Basis Wt. gram/square meter | 26.8 | 26.8 |
| Apparent Density kg/cubic meter | 165 | 133 |
| Transition Thickness (mm) | not observed | 0.033 |
| Knuckle Thickness (mm) | 0.069 | 0.056 |
| Pillow Thickness (mm) | 0.108 | 0.097 |

TABLE 2-continued

Properties of uncreped paper web handsheets.

| Property | Base | Pressed 250 PSI (Example 5) |
|---|---|---|
| T/K | na | 0.59 |
| P/K | 1.56 | 1.73 |
| Macro-Caliper mm | 0.16 | 0.20 |

While particular embodiments of the present invention have been illustrated and described, it would be obvious to those skilled in the art that various other changes and modifications can be made without departing from the spirit and scope of the present invention.

What is claimed:

1. A paper web comprising:

a first relatively high density, continuous network region having a first thickness K;

a second relatively low density region comprising a plurality of discrete, relatively low density domes dispersed throughout the continuous network region and isolated one from the other by the continuous network region, the relatively low density domes having a second thickness P; and a third region extending intermediate the continuous network and each of the relatively low density domes, the third region comprising a transition region encircling each of the low density domes and disposed adjacent the continuous network region, the transition region having a third thickness T;

wherein the thickness ratio P/K is greater than 1.0, and wherein the thickness ratio T/K is less than about 0.90.

2. The paper web of claim 1 wherein the thickness ratio T/K is less than about 0.80.

3. The paper web of claim 2 wherein the thickness ratio T/K is less than about 0.70.

4. The paper web of claim 3 wherein the thickness ratio T/K is less than about 0.65.

5. The paper web of claim 3 wherein the thickness ratio P/K is at least about 1.7.

6. The paper web of claim 5 wherein the thickness ratio P/K is at least about 2.0.

7. The paper web of claim 6 having a total tensile strength of at least about 1600 meters and a normalized stiffness index of less than about 5.5.

8. The paper web of claim 1 wherein the thickness ratio P/K is at least about 1.5.

9. The paper web of claim 8 wherein the thickness ratio P/K is at least about 1.7.

10. The paper web of claim 9 wherein the thickness ratio P/K is at least about 2.0.

11. The paper web of claim 1 wherein the web has a basis weight of between about 10 grams per square meter and about 65 grams per square meter and a macro-caliper of at least about 0.03 mm.

12. The paper web of claim 1 wherein the relatively low density domes are foreshortened.

13. The paper web of claim 1 having a total tensile strength of at least 300 meters.

14. The paper web of claim 1 having a normalized stiffness index of less than about 10.

15. The paper web of claim 6 having a total tensile strength of at least about 1600 meters and a normalized stiffness index of less than about 5.5.

16. The paper web of claim 1 having a normalized stiffness index of less than about 5.5.

* * * * *